US010186106B2

(12) United States Patent
Hughes et al.

(10) Patent No.: US 10,186,106 B2
(45) Date of Patent: Jan. 22, 2019

(54) GAMING SYSTEM AND METHOD FOR DETERMINING AWARDS BASED ON INTERACTING SYMBOLS

(71) Applicant: IGT, Las Vegas, NV (US)

(72) Inventors: William Keith Hughes, Reno, NV (US); Christian Gerchak, Sparks, NV (US); Cameron Filipour, Las Vegas, NV (US); Kimberly K. Maya, Reno, NV (US); Timothy Kennedy, Reno, NV (US)

(73) Assignee: IGT, Las Vegas, NV (US)

( * ) Notice: Subject to any disclaimer, the term of this patent is extended or adjusted under 35 U.S.C. 154(b) by 31 days.

(21) Appl. No.: 15/271,677

(22) Filed: Sep. 21, 2016

(65) Prior Publication Data

US 2018/0082519 A1 Mar. 22, 2018

(51) Int. Cl.
*G07F 17/34* (2006.01)
*G07F 17/32* (2006.01)

(52) U.S. Cl.
CPC ..... *G07F 17/3213* (2013.01); *G07F 17/3209* (2013.01); *G07F 17/3244* (2013.01); *G07F 17/3286* (2013.01)

(58) Field of Classification Search
None
See application file for complete search history.

(56) References Cited

U.S. PATENT DOCUMENTS

| | | | |
|---|---|---|---|
| 2,077,124 | A | 4/1937 | Miller et al. |
| 2,476,580 | A | 7/1949 | Bergman |
| 2,585,268 | A | 2/1952 | Olsen |
| 3,309,092 | A | 3/1967 | Hardesty |
| 3,420,525 | A | 1/1969 | Waders |
| 3,533,629 | A | 10/1970 | Raven |
| 3,580,581 | A | 5/1971 | Raven |
| 3,642,287 | A | 2/1972 | Lally et al. |
| 3,645,531 | A | 2/1972 | Wright |
| 3,695,615 | A | 10/1972 | Shoptaugh |
| 3,735,987 | A | 5/1973 | Ohki |
| 3,770,269 | A | 11/1973 | Elder |
| 3,834,712 | A | 9/1974 | Cox |
| 3,937,565 | A | 2/1976 | Alasia |
| 4,092,654 | A | 5/1978 | Alasia |
| 4,099,722 | A | 7/1978 | Rodesch et al. |
| 4,180,271 | A | 12/1979 | McMurchie |
| 4,184,683 | A | 1/1980 | Hooker |
| 4,190,256 | A | 2/1980 | Rudden, Jr. |
| 4,198,052 | A | 4/1980 | Gauselmann |
| 4,200,291 | A | 4/1980 | Hooker |
| 4,326,351 | A | 4/1982 | Heywood et al. |
| 4,346,900 | A | 8/1982 | Lamlee |
| 4,448,419 | A | 5/1984 | Telnaes |
| 4,492,378 | A | 1/1985 | Williams |

(Continued)

FOREIGN PATENT DOCUMENTS

| | | |
|---|---|---|
| AU | 5032796 | 10/1997 |
| AU | 6355398 | 10/1998 |

(Continued)

*Primary Examiner* — Tramar Harper

(74) *Attorney, Agent, or Firm* — Neal, Gerber & Eisenberg LLP

(57) ABSTRACT

In various embodiments, the present disclosure relates generally to gaming systems and methods for providing an interacting symbol game.

21 Claims, 19 Drawing Sheets

(56) References Cited

U.S. PATENT DOCUMENTS 4,508,345 A 4/1985 Okada
4,582,324 A 4/1986 Koza et al.
4,593,904 A 6/1986 Graves
4,614,344 A 9/1986 O'Connor
4,624,459 A 11/1986 Kaufman
4,636,951 A 1/1987 Harlick
4,648,600 A 3/1987 Olliges
4,669,731 A 6/1987 Clarke
4,695,053 A 9/1987 Vazquez, Jr. et al.
4,712,799 A 12/1987 Fraley
4,790,537 A 12/1988 Smyth et al.
4,826,169 A 5/1989 Bessho et al.
4,836,546 A 6/1989 DiRe et al.
4,838,552 A 6/1989 Hagiwara
4,874,173 A 10/1989 Kishishita
4,991,848 A 2/1991 Greenwood et al.
5,042,809 A 8/1991 Richardson
5,046,736 A 9/1991 Bridgeman et al.
5,085,436 A 2/1992 Bennett
5,092,598 A 3/1992 Kamille
5,100,137 A 3/1992 Fulton
5,102,134 A 4/1992 Smyth
5,102,137 A 4/1992 Ekiert
5,116,055 A 5/1992 Tracy
5,127,651 A 7/1992 Okada
5,152,529 A 10/1992 Okada
5,163,131 A 11/1992 Row et al.
5,167,413 A 12/1992 Fulton
5,178,390 A 1/1993 Okada
5,184,821 A 2/1993 Korenek
5,188,363 A 2/1993 Marvell, II et al.
5,205,555 A 4/1993 Hamano
RE34,244 E 5/1993 Hagiwara
5,209,479 A 5/1993 Nagao et al.
5,251,897 A 10/1993 Fulton
5,259,616 A 11/1993 Bergmann
5,265,877 A 11/1993 Boylan et al.
5,277,424 A 1/1994 Wilms
5,292,127 A 3/1994 Kelly et al.
5,324,040 A 6/1994 Panda
5,342,035 A 8/1994 Sugiyama et al.
5,342,047 A 8/1994 Heidel et al.
5,342,049 A 8/1994 Wichinsky et al.
5,344,144 A 9/1994 Canon
5,364,100 A 11/1994 Ludlow et al.
5,373,440 A 12/1994 Cohen et al.
5,393,061 A 2/1995 Manship et al.
5,395,111 A 3/1995 Inoue
5,397,125 A 3/1995 Adams
5,401,024 A 3/1995 Simunek
5,423,539 A 6/1995 Nagao
5,437,451 A 8/1995 Fulton
5,449,173 A 9/1995 Thomas et al.
5,456,465 A 10/1995 Durham
5,472,196 A 12/1995 Rusnak
5,511,781 A 4/1996 Wood et al.
5,524,888 A 6/1996 Heidel
5,536,016 A 7/1996 Thompson
5,553,851 A 9/1996 Malavazos et al.
5,560,603 A 10/1996 Seelig et al.
5,564,700 A 10/1996 Celona
5,569,084 A 10/1996 Nicastro et al.
5,580,053 A 12/1996 Crouch
5,580,055 A 12/1996 Hagiwara
5,580,309 A 12/1996 Piechowiak et al.
5,584,763 A 12/1996 Kelly et al.
5,584,764 A 12/1996 Inoue
5,609,524 A 3/1997 Inoue
5,611,535 A 3/1997 Tiberio
5,624,119 A 4/1997 Leake
5,630,586 A 5/1997 Lowden
5,639,089 A 6/1997 Matsumoto et al.
5,645,485 A 7/1997 Clapper, Jr.
5,647,798 A 7/1997 Falciglia
5,655,965 A 8/1997 Takemoto et al.
5,695,402 A 12/1997 Stupak
5,697,843 A 12/1997 Manship et al.
5,704,835 A 1/1998 Dietz, II
5,711,525 A 1/1998 Breeding
5,720,662 A 2/1998 Holmes, Jr. et al.
5,722,891 A 3/1998 Inoue
5,732,948 A 3/1998 Yoseloff
5,743,526 A 4/1998 Inoue
5,743,799 A 4/1998 Houriet, Jr. et al.
5,752,881 A 5/1998 Inoue
5,755,619 A 5/1998 Matsumoto et al.
5,766,074 A 6/1998 Cannon et al.
5,769,458 A 6/1998 Carides et al.
5,769,716 A 6/1998 Saffari et al.
5,775,692 A 7/1998 Watts et al.
5,779,544 A 7/1998 Seelig et al.
5,779,549 A 7/1998 Walker et al.
5,788,573 A 8/1998 Baerlocher et al.
5,791,989 A 8/1998 Slinkman
5,807,172 A 9/1998 Piechowiak
5,813,911 A 9/1998 Margolin
5,816,916 A 10/1998 Moody
5,817,172 A 10/1998 Yamada et al.
5,823,873 A 10/1998 Moody
5,823,874 A 10/1998 Adams
5,833,536 A 11/1998 Davids et al.
5,833,537 A 11/1998 Barrie
5,848,932 A 12/1998 Adams
5,851,010 A 12/1998 Feinberg
5,851,148 A 12/1998 Brune et al.
5,855,514 A 1/1999 Kamille
5,868,392 A 2/1999 Kraft
5,879,235 A 3/1999 Kaneko et al.
5,882,258 A 3/1999 Kelly et al.
5,882,259 A 3/1999 Holmes, Jr. et al.
5,882,260 A 3/1999 Marks et al.
5,882,261 A 3/1999 Adams
5,885,158 A 3/1999 Torango et al.
5,910,048 A 6/1999 Feinberg
5,911,418 A 6/1999 Adams
5,919,088 A 7/1999 Weiss
5,931,467 A 8/1999 Kamille
5,935,002 A 8/1999 Falciglia
5,947,820 A 9/1999 Morro et al.
5,951,397 A 9/1999 Dickinson
5,954,335 A 9/1999 Moody
5,967,893 A 10/1999 Lawrence et al.
5,971,849 A 10/1999 Falciglia
5,976,016 A 11/1999 Moody et al.
5,980,384 A 11/1999 Barrie
5,984,781 A 11/1999 Sunaga
5,984,782 A 11/1999 Inoue
5,993,316 A 11/1999 Coyle et al.
5,996,997 A 12/1999 Kamille
5,997,400 A 12/1999 Seelig et al.
5,997,401 A 12/1999 Crawford
6,004,207 A 12/1999 Wilson, Jr. et al.
6,012,982 A 1/2000 Piechowiak et al.
6,012,983 A 1/2000 Walker et al.
6,015,344 A 1/2000 Kelly et al.
6,015,346 A 1/2000 Bennett
6,019,374 A 2/2000 Breeding
6,027,115 A 2/2000 Griswold et al.
6,033,307 A 3/2000 Vancura
6,039,646 A 3/2000 Sells
6,045,129 A 4/2000 Cooper et al.
6,047,963 A 4/2000 Pierce et al.
6,050,895 A 4/2000 Luciano et al.
6,053,813 A 4/2000 Mathis
6,056,642 A 5/2000 Bennett
6,059,289 A 5/2000 Vancura
6,059,658 A 5/2000 Mangano et al.
6,062,980 A 5/2000 Luciano
6,077,163 A 6/2000 Walker et al.
6,082,734 A 7/2000 Uehara et al.
6,086,066 A 7/2000 Takeuchi et al.
6,089,976 A 7/2000 Schneider et al.
6,089,977 A 7/2000 Bennett
6,089,978 A 7/2000 Adams

(56) References Cited

U.S. PATENT DOCUMENTS 6,093,102 A 7/2000 Bennett
6,095,921 A 8/2000 Walker et al.
6,102,400 A 8/2000 Scott et al.
6,102,798 A 8/2000 Bennett
6,105,962 A 8/2000 Malavazos et al.
6,110,041 A 8/2000 Walker et al.
6,110,043 A 8/2000 Olsen
6,113,098 A 9/2000 Adams
6,117,009 A 9/2000 Yoseloff
6,117,013 A 9/2000 Eiba
6,120,031 A 9/2000 Adams
6,120,377 A 9/2000 McGinnis et al.
6,120,378 A 9/2000 Moody et al.
6,126,542 A 10/2000 Fier
6,129,632 A 10/2000 Luciano
6,135,885 A 10/2000 Lermusiaux
6,142,873 A 11/2000 Weiss et al.
6,142,874 A 11/2000 Kodachi et al.
6,142,875 A 11/2000 Kodachi et al.
6,146,273 A 11/2000 Olsen
6,149,156 A 11/2000 Feola
6,149,521 A 11/2000 Sanduski
6,155,925 A 12/2000 Giobbi et al.
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,186,894 B1 2/2001 Mayeroff
6,190,254 B1 2/2001 Bennett
6,190,255 B1 2/2001 Thomas et al.
6,203,429 B1 3/2001 Demar et al.
6,210,276 B1 4/2001 Mullins
6,210,277 B1 4/2001 Stefan
6,213,877 B1 4/2001 Walker et al.
6,217,448 B1 4/2001 Olsen
6,220,959 B1 4/2001 Holmes et al.
6,224,482 B1 5/2001 Bennett
6,224,483 B1 5/2001 Mayeroff
6,224,484 B1 5/2001 Okuda et al.
6,227,969 B1 5/2001 Yoseloff
6,227,971 B1 5/2001 Weiss
6,231,442 B1 5/2001 Mayeroff
6,231,445 B1 5/2001 Acres
6,234,879 B1 5/2001 Hasegawa et al.
6,234,897 B1 5/2001 Frohm et al.
6,237,913 B1 5/2001 Kamille
6,238,287 B1 5/2001 Komori et al.
6,238,288 B1 5/2001 Walker et al.
6,241,607 B1 6/2001 Payne et al.
6,244,957 B1 6/2001 Walker et al.
6,251,013 B1 6/2001 Bennett
6,254,482 B1 7/2001 Walker et al.
6,261,128 B1 7/2001 Heim et al.
6,261,177 B1 7/2001 Bennett
6,261,178 B1 7/2001 Bennett
6,267,669 B1 7/2001 Luciano, Jr. et al.
6,270,409 B1 8/2001 Shuster
6,270,410 B1 8/2001 DeMar et al.
6,270,411 B1 8/2001 Gura et al.
6,270,412 B1 8/2001 Crawford et al.
6,283,474 B1 9/2001 de Keller
6,283,861 B1 9/2001 Kawai et al.
6,287,194 B1 9/2001 Okada
6,288,993 B1 9/2001 Kawahara et al.
6,290,600 B1 9/2001 Glasson
6,293,866 B1 9/2001 Walker et al.
6,299,165 B1 10/2001 Nagano
6,302,790 B1 10/2001 Brossard
6,302,791 B1 10/2001 Frohm et al.
6,309,298 B1 10/2001 Gerow
6,309,299 B1 10/2001 Weiss
6,309,300 B1 10/2001 Glavich
6,311,976 B1 11/2001 Yoseloff et al.
6,312,331 B1 11/2001 Tamaki
6,312,334 B1 11/2001 Yoseloff
6,315,660 B1 11/2001 DeMar et al.
6,315,662 B1 11/2001 Jorasch et al.
6,315,664 B1 11/2001 Baerlocher et al.
6,319,124 B1 11/2001 Baerlocher et al.
6,322,309 B1 11/2001 Thomas et al.
6,328,649 B1 12/2001 Randall et al.
6,331,143 B1 12/2001 Yoseloff
6,334,814 B1 1/2002 Adams
6,334,864 B1 1/2002 Amplatz et al.
6,336,860 B1 1/2002 Webb
6,336,862 B1 1/2002 Byrne
6,340,158 B2 1/2002 Pierce et al.
6,343,988 B1 2/2002 Walker et al.
6,346,043 B1 2/2002 Colin et al.
6,347,996 B1 2/2002 Gilmore et al.
RE37,588 E 3/2002 Ornstein
6,358,147 B1 3/2002 Jaffe et al.
6,364,766 B1 4/2002 Anderson et al.
6,364,767 B1 4/2002 Brossard et al.
6,364,768 B1 4/2002 Acres et al.
6,368,216 B1 4/2002 Hedrick et al.
6,375,187 B1 4/2002 Baerlocher
6,375,567 B1 4/2002 Acres
6,375,570 B1 4/2002 Poole
6,386,974 B1 5/2002 Adams
6,394,902 B1 5/2002 Glavich et al.
6,398,218 B1 6/2002 Vancura
6,398,644 B1 6/2002 Perrie et al.
6,406,369 B1 6/2002 Baerlocher et al.
6,409,172 B1 6/2002 Vancura
6,409,597 B1 6/2002 Mizumoto
6,409,602 B1 6/2002 Wiltshire et al.
6,413,160 B1 7/2002 Vancura
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,435,502 B2 8/2002 Matos
6,439,995 B1 8/2002 Hughs-Baird et al.
6,443,837 B1 9/2002 Jaffe et al.
6,450,883 B1 9/2002 O'Halloran
6,454,651 B1 9/2002 Yoseloff
6,460,856 B2 10/2002 Davies
6,464,581 B1 10/2002 Yoseloff et al.
6,464,582 B1 10/2002 Baerlocher et al.
6,471,208 B2 10/2002 Yoseloff et al.
6,481,713 B2 11/2002 Perrie et al.
6,491,584 B2 12/2002 Graham et al.
6,494,785 B1 12/2002 Gerrard et al.
6,500,068 B2 12/2002 Walker et al.
6,501,899 B1 12/2002 Marrs et al.
6,506,116 B1 1/2003 Sunaga et al.
6,506,118 B1 1/2003 Baerlocher et al.
6,511,375 B1 1/2003 Kaminkow
6,514,141 B1 2/2003 Kaminkow et al.
6,517,432 B1 2/2003 Jaffe
6,517,433 B2 2/2003 Loose et al.
6,522,312 B2 2/2003 Ohshima et al.
6,533,658 B1 3/2003 Walker et al.
6,533,660 B2 3/2003 Seelig et al.
6,537,152 B2 3/2003 Seelig et al.
6,547,242 B1 4/2003 Sugiyama et al.
6,551,187 B1 4/2003 Jaffe
6,554,703 B1 4/2003 Bussick et al.
6,558,254 B2 5/2003 Baelocher et al.
6,561,899 B2 5/2003 Vancura
6,561,900 B1 * 5/2003 Baerlocher ..... G07F 17/34 273/143 R
6,561,904 B2 5/2003 Locke et al.
6,565,433 B1 5/2003 Baerlocher et al.

(56) References Cited

U.S. PATENT DOCUMENTS 6,569,016 B1 5/2003 Baerlocher
6,572,471 B1 6/2003 Bennett
6,572,472 B1 6/2003 Glavich
6,572,473 B1 6/2003 Baerlocher
6,575,830 B2 6/2003 Baerlocher et al.
6,581,935 B1 6/2003 Odom
6,582,307 B2 6/2003 Webb
6,592,457 B1 7/2003 Frohm et al.
6,595,854 B2 7/2003 Hughs-Baird et al.
6,599,187 B2 7/2003 Gerow
6,599,785 B2 7/2003 Hamada et al.
6,602,136 B1 8/2003 Baerlocher et al.
6,602,137 B2 8/2003 Kaminkow et al.
6,604,740 B1 * 8/2003 Singer ..... G07F 17/3262 273/143 R
6,604,999 B2 8/2003 Ainsworth
6,607,438 B2 8/2003 Baerlocher et al.
6,609,791 B1 8/2003 Miyamoto et al.
6,609,971 B2 8/2003 Vancura
6,612,575 B1 9/2003 Cole et al.
6,626,758 B1 9/2003 Parham et al.
6,632,138 B1 10/2003 Serizawa et al.
6,632,139 B1 10/2003 Baerlocher
6,632,141 B2 10/2003 Webb et al.
6,634,942 B2 10/2003 Walker et al.
6,634,943 B1 10/2003 Baerlocher
6,638,164 B2 10/2003 Randall et al.
6,641,477 B1 11/2003 Dietz, II
6,645,073 B2 11/2003 Lemay et al.
6,648,754 B2 11/2003 Baerlocher et al.
6,648,758 B2 11/2003 Bennett et al.
6,666,765 B2 12/2003 Vancura
6,666,767 B1 12/2003 Dayan
6,669,559 B1 12/2003 Baerlocher et al.
6,672,960 B1 1/2004 Jensen
6,676,126 B1 1/2004 Walker et al.
6,676,512 B2 1/2004 Fong et al.
6,676,516 B2 1/2004 Baerlocher et al.
6,688,977 B1 2/2004 Baerlocher et al.
6,692,356 B2 2/2004 Baerlocher et al.
6,695,696 B1 2/2004 Kaminkow
6,702,671 B2 3/2004 Tarantino
6,702,673 B2 3/2004 Webb
6,712,693 B1 3/2004 Hettinger
6,719,630 B1 4/2004 Seelig et al.
6,722,976 B2 4/2004 Adams
6,722,981 B2 4/2004 Kaminkow et al.
6,722,982 B2 4/2004 Kaminkow et al.
6,726,562 B2 4/2004 Vancura
6,731,313 B1 5/2004 Kaminkow
6,733,386 B2 5/2004 Cuddy et al.
6,746,016 B2 6/2004 Perrie et al.
6,746,328 B2 6/2004 Cannon et al.
6,746,329 B1 6/2004 Duhamel
6,749,502 B2 6/2004 Baerlocher
6,749,504 B2 6/2004 Hughs-Baird
6,752,717 B2 6/2004 Vancura
6,761,632 B2 7/2004 Bansemer et al.
6,761,633 B2 7/2004 Riendeau et al.
6,769,983 B2 8/2004 Slomiany
6,769,986 B2 8/2004 Vancura
6,780,103 B2 8/2004 Bansemer et al.
6,780,107 B2 8/2004 Baerlocher et al.
6,783,455 B2 8/2004 Glavich
6,783,457 B2 8/2004 Hughs-Baird et al.
6,786,818 B1 * 9/2004 Rothschild ..... G07F 17/32 436/16
6,786,820 B2 9/2004 Gerrard et al.
6,805,349 B2 10/2004 Baerlocher et al.
6,808,454 B2 10/2004 Gerrard et al.
6,811,482 B2 11/2004 Letovsky
6,817,944 B2 11/2004 Kaminkow et al.
6,824,465 B2 11/2004 Luciano et al.
6,840,858 B2 1/2005 Adams
6,843,722 B2 1/2005 Webb
6,843,723 B2 1/2005 Joshi
6,852,027 B2 2/2005 Kaminkow et al.
6,852,028 B2 2/2005 Vancura
6,855,053 B2 2/2005 Baerlocher
6,855,054 B2 2/2005 White et al.
6,855,055 B2 2/2005 Perrie et al.
6,863,606 B1 3/2005 Berg et al.
6,875,108 B1 4/2005 Hughs-Baird
6,878,061 B2 4/2005 Baerlocher et al.
6,893,341 B2 5/2005 Walker et al.
6,899,620 B2 5/2005 Kaminkow et al.
6,899,622 B2 5/2005 Lind et al.
6,908,383 B2 6/2005 Baerlocher et al.
6,910,962 B2 6/2005 Marks et al.
6,918,830 B2 7/2005 Baerlocher
6,918,832 B2 7/2005 Baerlocher et al.
6,918,834 B2 7/2005 Vancura
6,926,273 B1 8/2005 Vancura
6,929,545 B2 8/2005 Vancura
6,929,952 B2 8/2005 Baerlocher
6,932,701 B2 8/2005 Glavich et al.
6,935,947 B1 8/2005 Singer et al.
6,939,226 B1 9/2005 Joshi
6,939,229 B2 9/2005 McClintic
6,942,568 B2 9/2005 Baerlocher
6,958,013 B2 10/2005 Miereau et al.
6,960,133 B1 11/2005 Marks et al.
6,964,416 B2 11/2005 McClintic et al.
6,966,833 B2 11/2005 Kaminkow et al.
6,971,953 B2 12/2005 Gerrard et al.
6,981,635 B1 * 1/2006 Hughs-Baird ..... G07F 17/34 235/375
6,984,174 B2 1/2006 Cannon et al.
6,986,709 B2 1/2006 Hughs-Baird et al.
6,986,711 B2 1/2006 Vancura
6,988,732 B2 1/2006 Vancura
6,988,947 B2 1/2006 Baerlocher et al.
6,988,948 B2 1/2006 Perrie et al.
6,991,539 B2 1/2006 Pacey
6,997,805 B2 2/2006 Vancura
7,037,191 B2 5/2006 Rodgers et al.
7,040,983 B2 5/2006 Dolloff et al.
7,040,984 B2 5/2006 Mead
7,056,192 B2 6/2006 Venigalla et al.
7,056,210 B2 6/2006 Bansemer et al.
7,056,214 B2 6/2006 Miereau et al.
7,059,967 B2 6/2006 Baerlocher
7,070,502 B1 7/2006 Bussick et al.
7,070,503 B2 7/2006 Rudolph
7,073,793 B2 7/2006 Vancura
7,077,744 B2 7/2006 Cannon
7,086,945 B2 8/2006 Vancura
7,104,886 B2 9/2006 Baerlocher et al.
7,104,888 B2 9/2006 Miereau et al.
7,112,136 B2 9/2006 Anderson et al.
7,112,137 B2 9/2006 Baerlocher et al.
7,121,942 B2 10/2006 Baerlocher
7,128,646 B2 10/2006 Baerlocher et al.
7,128,647 B2 10/2006 Muir
7,144,322 B2 12/2006 Gomez et al.
7,160,186 B2 1/2007 Cuddy et al.
7,160,188 B2 1/2007 Kaminkow et al.
7,172,506 B2 2/2007 Baerlocher et al.
7,175,521 B2 2/2007 McClintic
7,175,524 B2 2/2007 Bansemer et al.
7,182,689 B2 2/2007 Hughs-Baird et al.
7,192,343 B2 3/2007 Vancura
7,192,347 B1 3/2007 Marks et al.
7,217,187 B2 5/2007 Vancura
7,229,350 B2 6/2007 Baerlocher et al.
7,234,700 B2 6/2007 Vancura
7,235,011 B2 6/2007 Randall et al.
7,247,096 B2 7/2007 Vancura
7,252,591 B2 8/2007 Van Asdale
7,264,545 B2 9/2007 Maya et al.
7,273,415 B2 9/2007 Cregan et al.
7,294,055 B2 11/2007 Baerlocher et al.
7,300,348 B2 11/2007 Kaminkow et al.
7,303,469 B2 12/2007 Kaminkow

(56) References Cited

U.S. PATENT DOCUMENTS 7,314,409 B2 1/2008 Maya et al.
7,316,609 B2 1/2008 Dunn et al.
7,326,114 B2 2/2008 Webb et al.
7,326,115 B2 2/2008 Baerlocher
7,335,102 B2 2/2008 Baerlocher et al.
7,338,367 B2 3/2008 Kaminkow et al.
7,338,369 B2 3/2008 Mierau et al.
7,341,512 B2 3/2008 Dolloff et al.
7,351,141 B2 4/2008 Rodgers et al.
7,357,713 B2 4/2008 Marks et al.
7,371,174 B2 5/2008 Baerlocher
7,377,849 B2 5/2008 Baerlocher et al.
7,399,226 B2 7/2008 Mishra
7,402,103 B2 7/2008 Baerlocher
7,413,510 B2 8/2008 Schlegel et al.
7,419,431 B2 9/2008 Gauselmann et al.
7,431,645 B2 10/2008 Han et al.
7,448,948 B2 11/2008 Hughs-Baird et al.
7,488,250 B2 2/2009 Baerlocher et al.
7,494,412 B2 2/2009 Baerlocher
7,541,252 B2 6/2009 Eun et al.
7,544,129 B2 6/2009 Baerlocher
7,556,561 B2 7/2009 White et al.
7,578,136 B2 8/2009 Derouineau et al.
7,578,735 B2 8/2009 Frizzell et al.
7,674,176 B2 3/2010 Berman et al.
7,699,696 B2 4/2010 Baerlocher et al.
7,704,141 B1 * 4/2010 Marks ..... G07F 17/34 463/16
7,708,627 B2 5/2010 Lind
7,749,063 B2 7/2010 Belger et al.
7,749,068 B2 7/2010 Cuddy et al.
8,007,358 B2 8/2011 Linard et al.
8,192,272 B2 6/2012 Thomas et al.
8,221,206 B2 7/2012 Marks et al.
8,251,798 B2 8/2012 Belger et al.
8,641,505 B2 2/2014 Spark-Stahl et al.
8,851,979 B2 10/2014 Basallo et al.
2001/0009865 A1 7/2001 DeMar et al.
2001/0024970 A1 9/2001 McKee et al.
2001/0038178 A1 11/2001 Vancura
2001/0040341 A1 11/2001 Kamille
2001/0041610 A1 11/2001 Luciano et al.
2002/0022509 A1 * 2/2002 Nicastro, II ..... G07F 17/32 463/15
2002/0049084 A1 4/2002 Hughs-Baird et al.
2002/0052230 A1 5/2002 Martinek et al.
2002/0052232 A1 5/2002 Kaminkow
2002/0052233 A1 5/2002 Gauselmann
2002/0053089 A1 5/2002 Massey
2002/0058545 A1 5/2002 Luciano
2002/0077165 A1 6/2002 Bansemer et al.
2002/0077172 A1 6/2002 Uchiyama et al.
2002/0086725 A1 7/2002 Fasbender et al.
2002/0147040 A1 10/2002 Walker et al.
2002/0151350 A1 10/2002 Baerlocher et al.
2002/0151351 A1 10/2002 Baerlocher et al.
2002/0160825 A1 10/2002 Nicastro et al.
2002/0198036 A1 12/2002 Baerlocher et al.
2002/0198039 A1 12/2002 Marks et al.
2003/0013518 A1 1/2003 Graham
2003/0017868 A1 1/2003 Crawford
2003/0027623 A1 2/2003 Rose
2003/0027624 A1 2/2003 Gilmore et al.
2003/0040358 A1 2/2003 Rothkranz et al.
2003/0045345 A1 3/2003 Berman
2003/0054874 A1 3/2003 Kaminkow
2003/0054875 A1 3/2003 Marks et al.
2003/0057645 A1 3/2003 Baerlocher et al.
2003/0060267 A1 3/2003 Glavich et al.
2003/0060271 A1 3/2003 Gilmore et al.
2003/0064786 A1 4/2003 Weiss
2003/0069057 A1 4/2003 Defrees-Parrott
2003/0069063 A1 * 4/2003 Bilyeu ..... G07F 17/32 463/20
2003/0073480 A1 4/2003 Thomas et al.
2003/0083943 A1 5/2003 Adams et al.
2003/0087687 A1 5/2003 Locke et al.
2003/0100356 A1 5/2003 Brown et al.
2003/0119576 A1 6/2003 McClintic et al.
2003/0125107 A1 7/2003 Cannon
2003/0130024 A1 7/2003 Darby
2003/0130028 A1 7/2003 Aida et al.
2003/0153375 A1 8/2003 Vancura
2003/0157981 A1 8/2003 Marks et al.
2003/0176210 A1 9/2003 Vancura
2003/0181234 A1 9/2003 Falciglia, Sr.
2003/0186737 A1 10/2003 Bennett et al.
2003/0190942 A1 10/2003 Kaminkow et al.
2003/0190945 A1 10/2003 Bussick et al.
2003/0195028 A1 10/2003 Glavich
2003/0207710 A1 11/2003 Rodgers et al.
2003/0211881 A1 11/2003 Walker et al.
2003/0216165 A1 11/2003 Singer et al.
2004/0004112 A1 1/2004 Petruccelli
2004/0014521 A1 1/2004 Seelig et al.
2004/0018872 A1 1/2004 Baerlocher et al.
2004/0018874 A1 1/2004 Bonney et al.
2004/0033829 A1 2/2004 Pacey et al.
2004/0036212 A1 2/2004 Walker et al.
2004/0048646 A1 * 3/2004 Visocnik ..... G07F 17/32 463/16
2004/0048649 A1 3/2004 Peterson et al.
2004/0053657 A1 3/2004 Fiden et al.
2004/0053662 A1 3/2004 Pacey
2004/0053665 A1 3/2004 Baerlocher
2004/0053669 A1 3/2004 Gerrard et al.
2004/0058727 A1 3/2004 Marks et al.
2004/0063493 A1 4/2004 Baerlocher
2004/0067790 A1 4/2004 Peterson et al.
2004/0082374 A1 4/2004 Maya et al.
2004/0082378 A1 4/2004 Peterson et al.
2004/0102238 A1 5/2004 Taylor
2004/0106444 A1 6/2004 Cuddy et al.
2004/0106445 A1 6/2004 Perrie et al.
2004/0137981 A1 7/2004 Gauselmann et al.
2004/0162133 A1 8/2004 Jackson
2004/0176156 A1 9/2004 Walker et al.
2004/0185927 A1 9/2004 Baerlocher et al.
2004/0192431 A1 9/2004 Singer et al.
2004/0195773 A1 10/2004 Masci et al.
2004/0204223 A1 10/2004 Cuddy et al.
2004/0217548 A1 11/2004 Snow
2004/0248639 A1 12/2004 Slomiany
2004/0266509 A1 12/2004 Bennett et al.
2005/0009597 A1 1/2005 Daly
2005/0014553 A1 1/2005 Byrne
2005/0020351 A1 1/2005 Baerlocher et al.
2005/0033461 A1 2/2005 Gerrard et al.
2005/0037836 A1 2/2005 Gilmore et al.
2005/0040601 A1 2/2005 Yoseloff et al.
2005/0043081 A1 2/2005 Baerlocher
2005/0049039 A1 * 3/2005 Webb ..... G07F 17/32 463/25
2005/0054405 A1 3/2005 Baerlocher et al.
2005/0054415 A1 3/2005 Kaminkow et al.
2005/0054416 A1 3/2005 Hostetler et al.
2005/0054434 A1 3/2005 Baerlocher et al.
2005/0054435 A1 3/2005 Rodgers et al.
2005/0054436 A1 3/2005 Frizzell et al.
2005/0059456 A1 3/2005 Mead et al.
2005/0059461 A1 3/2005 Ching et al.
2005/0071023 A1 3/2005 Gilliland et al.
2005/0096123 A1 5/2005 Cregan et al.
2005/0101372 A1 5/2005 Mierau et al.
2005/0101378 A1 5/2005 Kaminkow et al.
2005/0124406 A1 6/2005 Cannon
2005/0148384 A1 7/2005 Marks et al.
2005/0164793 A1 7/2005 Merimovich et al.
2005/0181853 A1 8/2005 Baerlocher
2005/0187011 A1 8/2005 Kaminkow
2005/0192081 A1 9/2005 Marks et al.
2005/0192091 A1 9/2005 Siewert et al.
2005/0239528 A1 10/2005 Moody

(56) References Cited

U.S. PATENT DOCUMENTS

| | | | | |
|---|---|---|---|---|
| 2005/0245307 | A1 | 11/2005 | Gatto et al. | |
| 2005/0282620 | A1 | 12/2005 | Marks et al. | |
| 2005/0288094 | A1 | 12/2005 | Marks et al. | |
| 2006/0003832 | A1 | 1/2006 | Mincey et al. | |
| 2006/0025196 | A1 | 2/2006 | Webb et al. | |
| 2006/0030387 | A1 | 2/2006 | Jackson | |
| 2006/0030401 | A1 | 2/2006 | Mead et al. | |
| 2006/0046836 | A1 | 3/2006 | Walker et al. | |
| 2006/0058095 | A1 | 3/2006 | Berman et al. | |
| 2006/0068882 | A1 | 3/2006 | Baerlocher et al. | |
| 2006/0068883 | A1 | 3/2006 | Randall et al. | |
| 2006/0073874 | A1 | 4/2006 | Cregan et al. | |
| 2006/0084497 | A1 | 4/2006 | Marks et al. | |
| 2006/0084500 | A1 | 4/2006 | Baerlocher et al. | |
| 2006/0121969 | A1 | 6/2006 | Marks et al. | |
| 2006/0121978 | A1 | 6/2006 | Hornik et al. | |
| 2006/0172795 | A1 | 8/2006 | Bussick et al. | |
| 2006/0183528 | A1 | 8/2006 | Rodgers et al. | |
| 2006/0183535 | A1 | 8/2006 | Marks et al. | |
| 2006/0205473 | A1 | 9/2006 | Gomez et al. | |
| 2006/0205474 | A1 | 9/2006 | Bansemer et al. | |
| 2006/0246977 | A1 | 11/2006 | Cannon | |
| 2006/0276243 | A1 | 12/2006 | Reisdorff et al. | |
| 2007/0015566 | A1 | 1/2007 | Baerlocher et al. | |
| 2007/0021176 | A1 | 1/2007 | Jackson | |
| 2007/0026923 | A1 | 2/2007 | Muir | |
| 2007/0032285 | A1 | 2/2007 | Wolf | |
| 2007/0060271 | A1 | 3/2007 | Cregan et al. | |
| 2007/0087809 | A1 | 4/2007 | Baerlocher | |
| 2007/0111783 | A1 | 5/2007 | Cuddy et al. | |
| 2007/0117606 | A1 | 5/2007 | Baerlocher et al. | |
| 2007/0129128 | A1 | 6/2007 | McClintic | |
| 2007/0129131 | A1 | 6/2007 | Kaminkow et al. | |
| 2007/0129133 | A1 | 6/2007 | Bansemer et al. | |
| 2007/0149267 | A1 | 6/2007 | Ross et al. | |
| 2007/0149269 | A1 | 6/2007 | Benbrahim | |
| 2008/0004105 | A1 | 1/2008 | Cregan et al. | |
| 2008/0119283 | A1 | 5/2008 | Baerlocher | |
| 2008/0132321 | A1* | 6/2008 | Pau | G07F 17/32 463/20 |
| 2008/0146321 | A1 | 6/2008 | Parente | |
| 2008/0188287 | A1 | 8/2008 | Schlegel et al. | |
| 2008/0200238 | A1 | 8/2008 | Mishra | |
| 2008/0311980 | A1 | 12/2008 | Cannon | |
| 2008/0318663 | A1* | 12/2008 | Yokota | G07F 17/3244 463/20 |
| 2009/0104959 | A1 | 4/2009 | Caputo et al. | |
| 2009/0124326 | A1 | 5/2009 | Caputo et al. | |
| 2009/0166971 | A1 | 7/2009 | Mebane | |
| 2010/0120507 | A1* | 5/2010 | Rodgers | G07F 17/3262 463/20 |
| 2011/0039614 | A1 | 2/2011 | Caputo et al. | |

FOREIGN PATENT DOCUMENTS

| | | |
|---|---|---|
| AU | 711501 | 10/1999 |
| CA | 2288723 | 10/1998 |
| EP | 219305 | 4/1987 |
| EP | 0698869 | 2/1996 |
| EP | 0798676 | 10/1997 |
| EP | 0874337 | 10/1998 |
| EP | 0945837 | 3/1999 |
| EP | 1083531 | 3/2001 |
| EP | 1205897 | 10/2001 |
| EP | 1298601 | 4/2003 |
| EP | 1336941 | 8/2003 |
| EP | 1617386 | 1/2006 |
| EP | 1635306 | 3/2006 |
| EP | 1653416 | 5/2006 |
| GB | 2089086 | 6/1982 |
| GB | 2090690 | 7/1982 |
| GB | 2096376 | 10/1982 |
| GB | 2097160 | 10/1982 |
| GB | 2100905 | 1/1983 |
| GB | 2105891 | 3/1983 |
| GB | 2106682 | 4/1983 |
| GB | 2117155 | 10/1983 |
| GB | 2130413 | 5/1984 |
| GB | 2137392 | 10/1984 |
| GB | 2144644 | 3/1985 |
| GB | 2147442 | 5/1985 |
| GB | 2147773 | 5/1985 |
| GB | 2161008 | 1/1986 |
| GB | 2183882 | 6/1986 |
| GB | 2170643 | 8/1986 |
| GB | 2181589 | 4/1987 |
| GB | 2190227 | 11/1987 |
| GB | 2191030 | 12/1987 |
| GB | 2201821 | 9/1988 |
| GB | 2213624 | 8/1989 |
| GB | 2222712 | 3/1990 |
| GB | 2225889 | 6/1990 |
| GB | 2226436 | 6/1990 |
| GB | 2242300 | 9/1991 |
| GB | 2262642 | 6/1993 |
| GB | 2316214 | 2/1998 |
| GB | 2328311 | 2/1999 |
| GB | 2333880 | 8/1999 |
| GB | 2341262 | 3/2000 |
| GB | 2353128 | 2/2001 |
| GB | 2372132 | 8/2002 |
| GB | 2422121 | 7/2006 |
| WO | 85/00910 | 2/1985 |
| WO | 96/35491 | 11/1996 |
| WO | 97/32285 | 9/1997 |
| WO | 98/51384 | 11/1998 |
| WO | 99/64997 | 12/1999 |
| WO | 00/12186 | 3/2000 |
| WO | 00/32286 | 6/2000 |
| WO | 01/15055 | 3/2001 |
| WO | 01/26019 | 4/2001 |
| WO | 01/41892 | 6/2001 |
| WO | 01/74464 | 10/2001 |
| WO | 01/93967 | 12/2001 |
| WO | 02/077935 | 10/2002 |
| WO | 02/102484 | 12/2002 |
| WO | 03/089084 | 10/2003 |
| WO | 03/089088 | 10/2003 |
| WO | 2005/009560 | 3/2005 |
| WO | 2005/027058 | 3/2005 |
| WO | 2005/027061 | 3/2005 |
| WO | 2005/035080 | 4/2005 |
| WO | 2005/057339 | 6/2005 |
| WO | 2005/075037 | 8/2005 |
| WO | 2005/086018 | 9/2005 |
| WO | 2005/105241 | 11/2005 |
| WO | 2006/009248 | 1/2006 |
| WO | 2007/021724 | 7/2007 |

* cited by examiner

GAMING SYSTEM AND METHOD FOR DETERMINING AWARDS BASED ON INTERACTING SYMBOLS

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards. In such known gaming machines, the amount of the wager made on the base game by the player can vary.

Secondary or bonus games are also known in gaming machines. The secondary or bonus games usually provide an additional award to the player. Secondary or bonus games usually do not require an additional wager by the player to be activated. Certain secondary or bonus games are activated or hit upon an occurrence of a designated triggering symbol or triggering symbol combination in the primary or base game. For instance, a bonus symbol occurring on the payline on the third reel of a three reel slot machine may hit the secondary bonus game. Part of the enjoyment and excitement of playing certain gaming machines is the occurrence or triggering of the secondary or bonus game (even before the player knows how much the bonus award will be).

There is a continuing need to provide new and different gaming systems that provide awards to players utilizing interacting symbols.

SUMMARY

In various embodiments, the present disclosure relates generally to gaming systems and methods for providing an interacting symbol game. In such embodiments, the interacting symbol game includes: (i) a plurality of symbol display positions which form a matrix, (ii) one or more eliminator display positions distinct from and associated with the matrix, (iii) a plurality of target symbols each associated with one or more characteristics, attributes or parameters, and (iv) one or more eliminator symbols each associated with one or more characteristics, attributes or parameters. In operation of such embodiments, the gaming system displays a plurality of the target symbols and zero, one or more non-target, non-eliminator symbols populating the matrix of symbol display positions. The gaming system further displays one or more eliminator symbols populating the eliminator display positions. The gaming system determines if any of the displayed eliminator symbols displayed at the eliminator display positions eliminate any of the displayed target symbols. Such elimination determinations are based on the characteristics, attributes or parameters associated with the displayed eliminator symbols compared to the characteristics, attributes or parameters associated with the displayed target symbols. Put differently, based on how a characteristic of a displayed eliminator symbol interacts with a characteristic of a displayed target symbol determines whether or not the displayed eliminator symbol eliminates one or more displayed target symbols. Following zero, one or more eliminations of one or more target symbols by one or more eliminator symbols, the gaming system determines and displays an award, wherein the determined award is based, at least in part, on which target symbols were eliminated. Such a configuration provides an additional level of randomness in how to determine one or more awards based on how one set of randomly determined eliminator symbols interact with another set of randomly determined target symbols. Such a configuration further provides different ways to utilize randomly generated symbols to provide different awards, thus increasing the anticipation associated with which symbols will be eliminated and which symbols will avoid elimination.

More specifically, in operation of certain embodiments, upon an initiation of the interacting symbol game disclosed herein, the gaming system displays a symbol display position matrix including a plurality of symbol display positions. The gaming system also display one or more eliminator display positions associated with but otherwise distinct from the symbol display positions. Each eliminator display position is associated with one or more symbol display positions of the matrix, such as located adjacent to at least one of the symbol display positions of the matrix. In certain embodiments, the plurality of eliminator display positions are associated with an eliminator symbol generator, such as an eliminator symbol reel.

In operation of at least one play of a game utilizing such display positions, the gaming system display one of a plurality of different randomly generated symbols at each symbol display position of the symbol display position matrix. The symbols generated at such symbol display positions include target symbols and zero, one or more non-target, non-eliminator symbols. In these embodiments, for one or more symbol display positions, the gaming system randomly selects one of a plurality of different target symbols wherein each different target symbol is associated with a different characteristic, attribute or parameter, such as a size of a target symbol.

In addition to displaying different target symbols and zero, one or more non-target, non-eliminator symbols at the symbol display positions, the gaming system displays one or more randomly generated eliminator symbols at the eliminator display positions. In these embodiments, for one or more eliminator display positions, the gaming system randomly selects one of a plurality of different eliminator symbols wherein each different eliminator symbol is associated with a different characteristic, attribute or parameter, such as a size of an eliminator symbol.

After displaying the symbols at the different symbol display positions and at least one eliminator at at least one eliminator display position and, in at least one embodiment, analyzing the symbols at the different symbol display positions for any associated awards, the gaming system determines whether any of the eliminators cause an elimination of any of the symbols displayed at the symbol display positions. That is, in association with the gaming system displaying one or more target symbols at one or more symbol display positions, the gaming system determines if any eliminator symbols at any eliminator display positions eliminate zero, one or more of such target symbols. In certain embodiments, for one, more or each of the target symbols displayed at one, more or each of the symbol display positions associated with an eliminator display position, the gaming system determines, based on one or more interactions between the target symbol and one or more eliminators, whether or not the eliminator of that eliminator display position eliminates, nullifies or otherwise destroys such a target symbol. In certain such embodiments, different target symbols and/or different eliminators have different attributes, characteristics or parameters such that different eliminators have different affects on different target symbols. In these embodiments, the determination of whether an eliminator eliminates a target symbol is based on the attributes, characteristics or parameters of the target symbol and/or the attributes, characteristics or parameters of the eliminator. For example, a first eliminator of a first size is configured to eliminate a first target symbol of a first size, but not affect or eliminate a second, different target symbol of a second, larger size. It should be appreciated that in certain embodiments, the same symbol qualifies as both a target symbol and an eliminator symbol. That is, a first symbol may qualify as: (i) an eliminator symbol to a second symbol (i.e., the characteristics, attributes or parameters of the first symbol relative to the characteristics, attributes or parameters of the second symbol dictate that when the first symbol engages the second symbol, the first symbol eliminates the second symbol) and (ii) a target symbol to a third symbol (i.e., the characteristics, attributes or parameters of the first symbol relative to the characteristics, attributes or parameters of the third symbol dictate that when the first symbol engages the third symbol, the first symbol is eliminated by the third symbol).

If the gaming system determines that the eliminator eliminates, nullifies or otherwise destroys a target symbol, the gaming system removes the eliminated target symbol from the symbol display position of the matrix. On the other hand, if the gaming system determines that an eliminator does not eliminate a displayed target symbol, the gaming system determines if any associated target symbols remain for the eliminator to potentially eliminate. The gaming system then repeats this process until determining that no more qualifying eliminators eliminate any remaining target symbols.

Following zero, one or more eliminators eliminating zero, one or more target symbols of the symbol display matrix, the gaming system determines and displays an award. In one such embodiment, the award is based on the quantity of eliminated symbols. Such configurations increase the level of excitement and enjoyment for players because as the play of the game progresses, zero, one or more symbols are eliminated, wherein such eliminated symbols affect the amount of the award ultimately provided to the player. Such configurations further provide, for certain players, an increased amount of anticipation associated with not knowing which eliminator symbols and which target symbols will be randomly generated and thus not knowing how such eliminator symbols will interact with such target symbols to determine one or more awards.

Additional features and advantages are described in, and will be apparent from, the following Detailed Description and the figures.

DETAILED DESCRIPTION

Interacting Symbols

Figure 1:
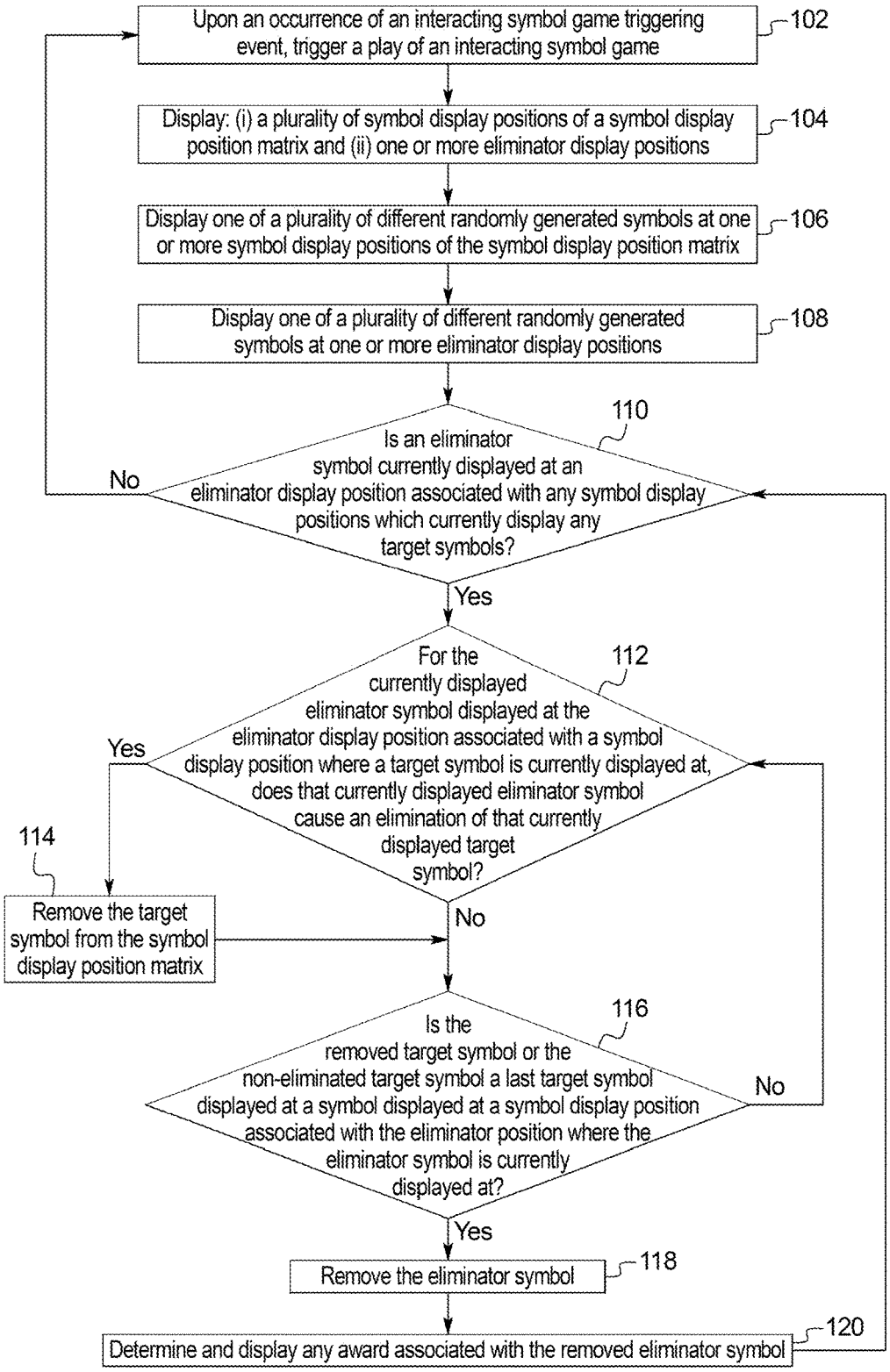
FIG. 1 is a flow chart an example process for operating a gaming system providing one embodiment of the interacting symbol game disclosed herein.

In various embodiments, the present disclosure relates generally to gaming systems and methods for providing an interacting symbol game. In such embodiments, the interacting symbol game includes: (i) a plurality of symbol display positions which form a matrix, (ii) one or more eliminator display positions distinct from and associated with the matrix, (iii) a plurality of target symbols each associated with one or more characteristics, attributes or parameters, and (iv) one or more eliminator symbols each associated with one or more characteristics, attributes or parameters. In operation of such embodiments, the gaming system displays a plurality of the target symbols and zero, one or more non-target, non-eliminator symbols populating the matrix of symbol display positions. The gaming system further displays one or more eliminator symbols populating the eliminator display positions. The gaming system determines if any of the displayed eliminator symbols displayed at the eliminator display positions eliminate any of the displayed target symbols. Such elimination determinations are based on the characteristics, attributes or parameters associated with the displayed eliminator symbols compared to the characteristics, attributes or parameters associated with the displayed target symbols. Put differently, based on how a characteristic of a displayed eliminator symbol interacts with a characteristic of a displayed target symbol determines whether or not the displayed eliminator symbol eliminates one or more displayed target symbols. Following zero, one or more eliminations of one or more target symbols by one or more eliminator symbols, the gaming system determines and displays an award, wherein the determined award is based, at least in part, on which target symbols were eliminated. Such a configuration provides an additional level of randomness in how to determine one or more awards based on how one set of randomly determined eliminator symbols interact with another set of randomly determined target symbols. Such a configuration further provides different ways to utilize randomly generated symbols to provide different awards, thus increasing the anticipation associated with which symbols will be eliminated and which symbols will avoid elimination.

While certain embodiments described below are directed to a primary game, such as a primary wagering game, it should be appreciated that such embodiments may additionally or alternatively be employed in association with a secondary or bonus game. Additionally, while certain embodiments described below are directed to a secondary game, it should be appreciated that such embodiments may additionally or alternatively be employed in association with a primary game, such as a primary wagering game. Moreover, while the player's credit balance, the player's wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

FIG. 1 is a flowchart of an example process or method of operating the gaming system of the present disclosure. In various embodiments, the process is represented by a set of instructions stored in one or more memories and executed by one or more processors. Although the process is described with reference to the flowchart shown in FIG. 1, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

In different embodiments, upon an occurrence of an interacting symbol game triggering event, as indicated in block 102 of FIG. 1, the gaming system triggers a play of an interacting symbol game. In one embodiment, the interacting symbol game is a primary game wherein an interacting symbol game triggering event occurs upon a player placing a wager to play the interacting symbol game. In another embodiment, the interacting symbol game is a secondary or bonus game wherein an interacting symbol game triggering event occurs based on a displayed event associated with a wagered on play of a primary game. In another embodiment wherein the interacting symbol game is a secondary or bonus game, an interacting symbol game triggering event occurs based on an event independent of any displayed event associated with a wagered on play of a primary game.

Figure 2A:
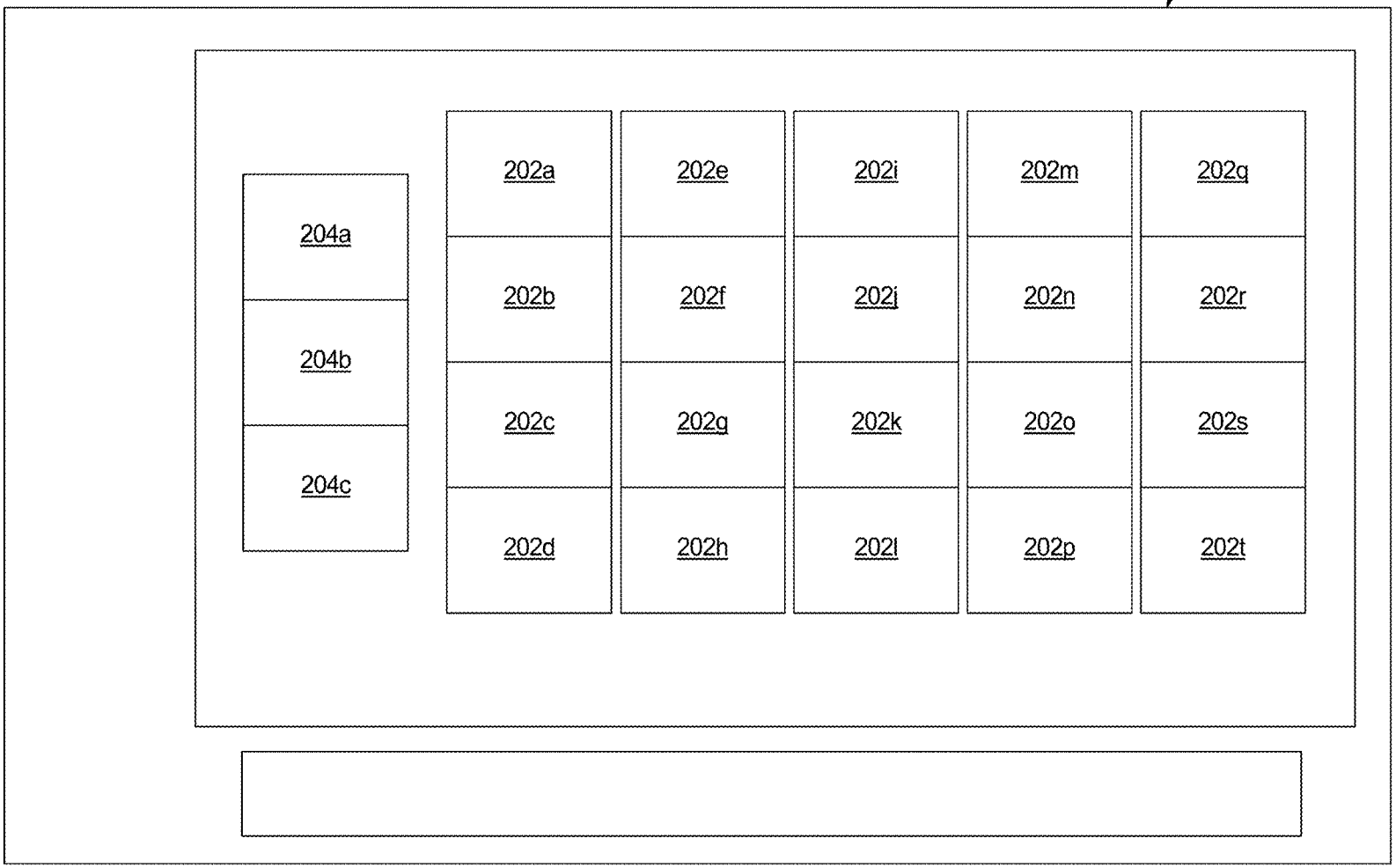
FIGS. 2A, 2B, 2C, 2D, 2E, 2F, 2G, 2H, 2I, 2J, 2K, 2L, 2M and 2N are front views of one embodiment of the gaming system disclosed herein illustrating a play of an interacting symbol game.

In different embodiments, for the triggered interacting symbol game, the gaming system displays a plurality of symbol display positions of a symbol display position matrix and displays one or more eliminator display positions as indicated in block 104. For example, as seen in FIG. 2A, the gaming system displays symbol display positions 202*a* to 202*t* and eliminator display positions 204*a* to 204*c*.

In different embodiments, each eliminator display position is separate from, but otherwise associated with one or more of the symbol display positions of the matrix. In certain embodiments, such as seen in FIG. 2A, each eliminator display position is associated with each of the symbol display positions of the matrix. In other embodiments, certain eliminator display positions are associated with certain of the symbol display positions of the matrix and not associated with certain other symbol display positions of the matrix. For example, a plurality of reels associated with the symbol display positions form the symbol display position matrix, wherein an eliminator reel (including the plurality of eliminator display positions) is displayed adjacent to at least one of the reels of the symbol display position matrix. In this example, the symbol display position matrix includes a plurality of paylines wherein each eliminator display position is located adjacent to and associated with one or more of such symbol display position matrix paylines (i.e., the eliminator display position is displayed along a payline and is associated with each of the symbol display positions along the same payline).

Following the gaming system displaying the symbol display positions of the symbol display position matrix and displaying one or more eliminator display positions, as indicated by block 106 of FIG. 1, the gaming system displays one of a plurality of different randomly generated symbols at one or more symbol display positions of the symbol display position matrix.

In certain embodiments wherein the interacting symbol game is a primary game, the gaming system generates one or more target symbols and zero, one or more non-target, non-eliminator symbols. Such non-target, non-eliminator symbols includes any suitable symbol such as, game symbols and/or wild symbols. In these embodiments, for one or more symbol display positions, the gaming system randomly selects one of a plurality of different target symbols wherein two or more of the different target symbols are each associated with a different characteristic, attribute or parameter. In certain embodiments, one or more of the target symbols also function as game symbols for the play of the wagering game, such as major symbols and/or minor symbols.

In certain embodiments wherein the interacting symbol game is a secondary game, the symbols generated at such symbol display positions include one or more target symbols and zero, one or more non-target, non-eliminator symbols, such as blank symbols. In these embodiments, for one or more symbol display positions, the gaming system randomly selects one of a plurality of different target symbols wherein two or more of the different target symbols are each associated with a different characteristic, attribute or parameter.

In one such embodiment wherein the interacting symbol game is a secondary game, following the play of the primary game, the gaming system removes any displayed primary game symbols and then proceeds with generating one or more target symbols and zero, one or more non-target, non-eliminator symbols at the symbol display positions.

In another such embodiment wherein the interacting symbol game is a secondary game which is triggered by a plurality of displayed interacting symbol game triggering symbols (displayed at the symbol display positions and/or at the eliminator display positions), following the play of the primary game, the gaming system removes the displayed interacting symbol game triggering symbols and any primary game symbols. In this embodiment, the gaming system then proceeds with generating target symbols to replace the removed interacting symbol game triggering symbols.

Figure 2B:
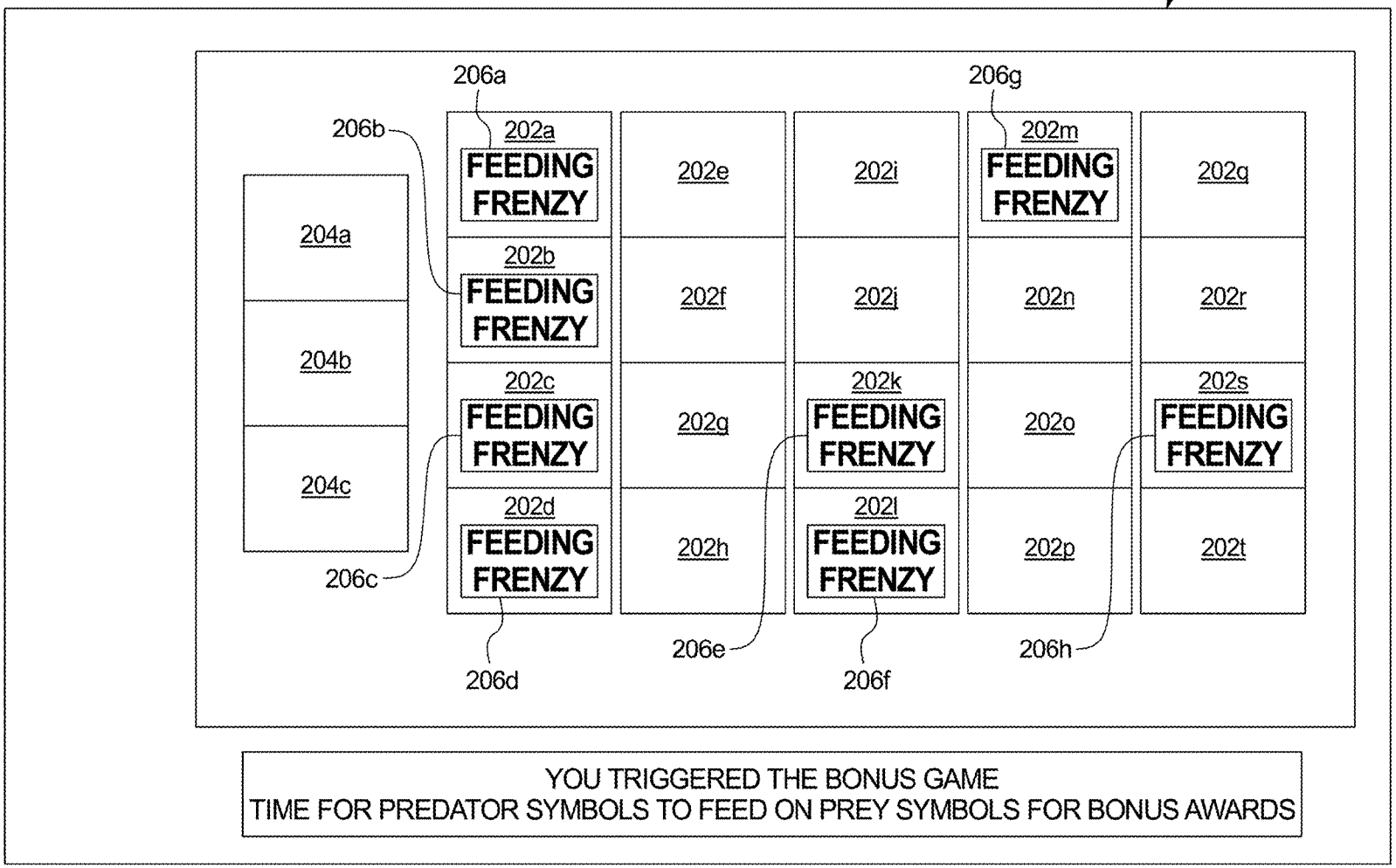
Figure 2C:
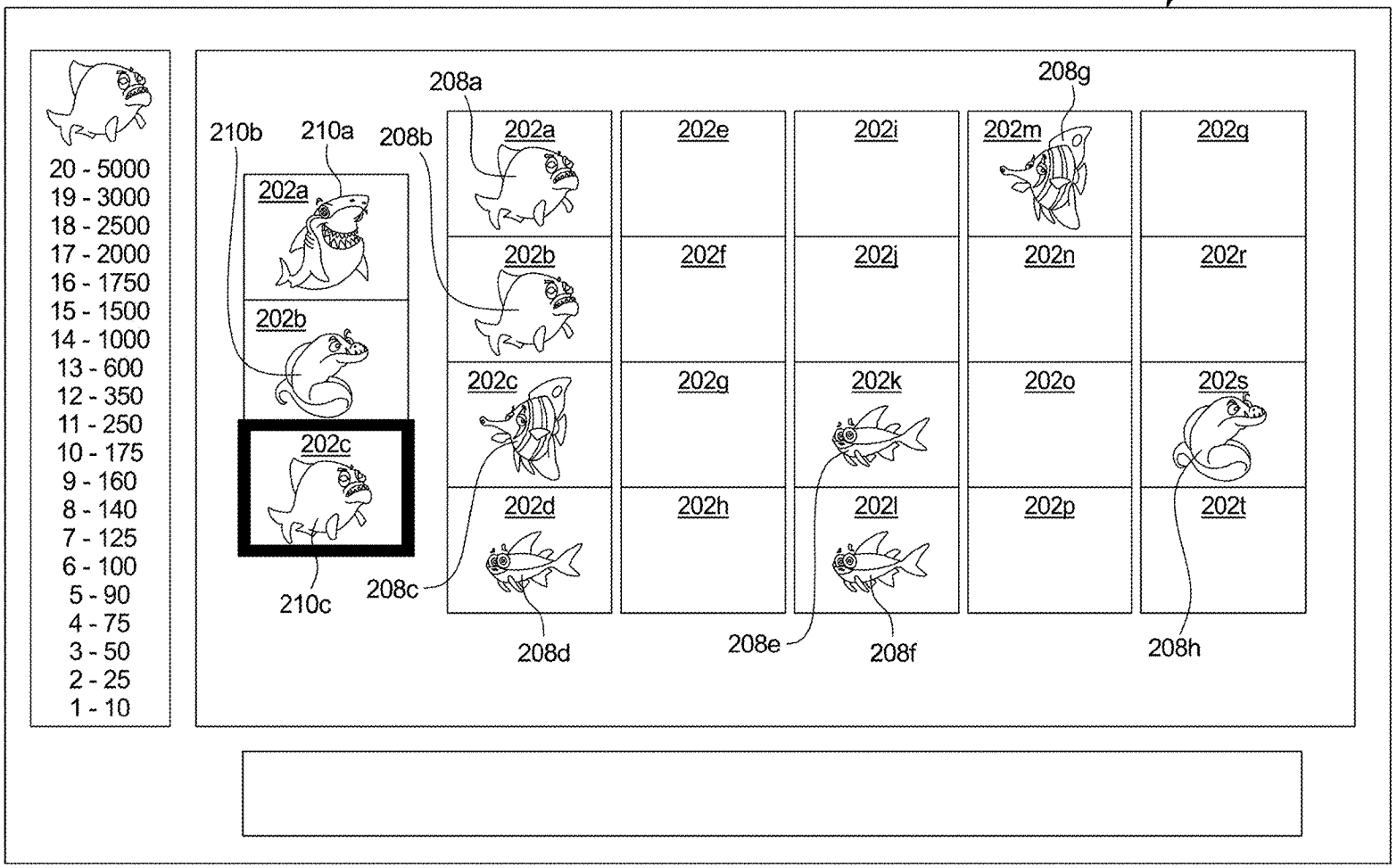

For example, as seen in FIGS. 2B to 2C, following the generation of a plurality of interacting symbol game triggering symbols 206*a*, 206*b*, 206*c*, 206*d*, 206*e*, 206*f*, 206*g* and 206*h* at symbol display positions 202*a*, 202*b*, 202*c*, 202*d*, 202*k*, 2021, 202*m* and 202*s*, respectively, of symbol display position matrix in association with a play of a primary game and following the removal of any primary game symbols (i.e., any non-target, non-eliminator symbols) from the symbol display positions (not shown), the gaming system displays target symbols 208*a*, 208*b*, 208*c*, 208*d*, 208*e*, 208*f*, 208*g* and 208*h* at symbol display positions 202*a*, 202*b*, 202*c*, 202*d*, 202*k*, 202, 202*m* and 202*s*, respectively, of symbol display position matrix. It should be appreciated that in this example, different target symbols have different attributes of size (e.g., target symbol 206*a* is larger than target symbol 206*d*) which, as described below, at least partially determine if that target symbol is eliminated by an eliminator symbol. In this example, the gaming system provides appropriate messages such as "YOU TRIGGERED THE BONUS GAME" and "TIME FOR PREDATOR SYMBOLS TO FED ON PREY SYMBOLS FOR BONUS AWARDS" to the player visually, or through suitable audio or audiovisual displays.

In certain embodiments, the symbols generated at such symbol display positions include target symbols without any non-target, non-eliminator symbols. In these embodiments, for one or more symbol display positions, the gaming system randomly selects one of a plurality of different target symbols wherein different target symbol are each associated with a different characteristic, attribute or parameter.

In certain embodiments, upon a determination to display a target symbol at a symbol display position, the gaming system displays a single target symbol at that symbol display position. In different embodiments, upon a determination to display a target symbol at a symbol display position, the gaming system displays a plurality of target symbols at that symbol display position. In one such embodiment, the gaming system displays a plurality of the same target symbol at the single symbol display position. In this embodiment, each target symbol displayed at the single symbol display is associated with the same characteristics, attributes or parameters. In another such embodiment, the gaming system displays a plurality of different target symbols at the single symbol display position. In this embodiment, each different target symbol displayed at the single symbol display is associated with one or more different characteristics, attributes or parameters.

In one such embodiment wherein a plurality of target symbols are displayed at a single symbol display position, the gaming system evaluates each of such target symbols individually to determine, as described below, if such a target symbol will be eliminated. In another embodiment wherein a plurality of target symbols are displayed at a single symbol display position, the gaming system individually evaluates a plurality of, but less than all, of such target symbols to determine, as described below, if such target symbols will be eliminated. In another embodiment wherein a plurality of target symbols are displayed at a single symbol display position, the gaming system selects one of the target symbols, such as a randomly selected target symbol or a target symbol associated with certain characteristics, attributes or parameters and individually evaluates that selected target symbol to determine, as described below, if such a target symbol will be eliminated.

In certain embodiments, different wager amounts placed in association with the play of the interacting symbols game (i.e., either on an interacting symbol primary game or on a wagering game associated with an interacting symbol secondary game) are associated with different available target symbols. In an additional or alternative embodiment, different wager amounts placed in association with the play of the interacting symbols game are associated with different quantities of target symbols available to be generated. In an additional or alternative embodiment, different wager amounts placed in association with the play of the interacting symbols game are associated with different probabilities of generating one or more target symbols at one or more symbol display positions. For example, the greater the wager amount placed, the greater the probability of each symbol display position displaying a target symbol having relatively weak associated characteristics, attributes or parameters.

In addition to displaying a plurality of randomly generated symbols at the symbol display positions, as indicated by block 108 of FIG. 1, the gaming system displays one of a plurality of different randomly generated symbols at one or more eliminator display positions.

In certain embodiments wherein the interacting symbol game is a primary game, the gaming system generates one or more eliminator symbols and zero, one or more non-target, non-eliminator symbols, such as blank symbols. In these embodiments, for one or more eliminator display positions, the gaming system randomly selects one of a plurality of different eliminator symbols, wherein two or more of the different eliminator symbols are each associated with a different characteristic, attribute or parameter. In different embodiments, the display of such eliminator symbols occurs before, concurrently with or after the display of the symbols at the symbol display positions of the symbol display position matrix.

In certain embodiments wherein the interacting symbol game is a secondary game, the symbols generated at such symbol display positions include one or more eliminator symbols and zero, one or more non-target, non-eliminator symbols, such as blank symbols. In these embodiments, for one or more eliminator display positions, the gaming system randomly selects one of a plurality of different eliminator symbols wherein two or more of the different eliminator symbols are each associated with a different characteristic, attribute or parameter. For example, as seen in FIG. 2C, the gaming system displays eliminator symbols 210*a*, 210*b* and 210*c* at eliminator display positions 204*a*, 204*b* and 204*c*, respectively. As seen in this example, different eliminator symbols have different attributes of size (e.g., eliminator symbol 210*a* is larger than eliminator symbol 210*c*) which, as described below, at least partially determine which target symbols that eliminator symbol will eliminate. It should be appreciated that while this example illustrates the generator of one or more eliminator symbols prior to or concurrently with the trigging of the interacting symbol secondary game, the display of such eliminator symbols may occur after the triggering of the interacting symbols secondary game.

In certain embodiments, the symbols generated at such eliminator display positions include eliminator symbols without any non-target, non-eliminator symbols, such as blank symbols. In these embodiments, for each of eliminator display positions, the gaming system randomly selects one of a plurality of different eliminator symbols wherein each different eliminator symbols are each associated with a different characteristic, attribute or parameter.

It should be appreciated that in certain embodiments, the same symbol qualifies as both a target symbol and an eliminator symbol. That is, a first symbol may qualify as: (i) an eliminator symbol to a second symbol (i.e., the characteristics, attributes or parameters of the first symbol relative to the characteristics, attributes or parameters of the second symbol dictate that when the first symbol engages the second symbol, the first symbol eliminates the second symbol) and (ii) a target symbol to a third symbol (i.e., the characteristics, attributes or parameters of the first symbol relative to the characteristics, attributes or parameters of the third symbol dictate that when the first symbol engages the third symbol, the first symbol is eliminated by the third symbol).

In certain embodiments, upon a determination to display an eliminator symbol at an eliminator display position, the gaming system displays a single eliminator symbol at that eliminator display position. In different embodiments, upon a determination to display an eliminator symbol at an eliminator display position, the gaming system displays a plurality of eliminator symbols at that eliminator display position. In one such embodiment, the gaming system displays a plurality of the same eliminator symbol at the single eliminator display position. In this embodiment, each eliminator symbol displayed at the single symbol display is associated with the same characteristics, attributes or parameters. In another such embodiment, the gaming system displays a plurality of different eliminator symbols at the single eliminator display position. In this embodiment, each different eliminator symbol displayed at the single symbol display is associated with one or more different characteristics, attributes or parameters.

In one such embodiment wherein a plurality of eliminator symbols are displayed at a single eliminator display position, the gaming system evaluates each of such eliminator symbols individually to determine, as described below, if such an eliminator symbol will eliminate any target symbols. In another embodiment wherein a plurality of eliminator symbols are displayed at a single eliminator display position, the gaming system individually evaluates a plurality of, but less than all, of such eliminator symbols to determine, as described below, if such eliminator symbols will eliminate any target symbols. In another embodiment wherein a plurality of eliminator symbols are displayed at a single eliminator display position, the gaming system selects one of the eliminator symbols, such as a randomly selected eliminator symbol or a eliminator symbol associated with certain characteristics, attributes or parameters and individually evaluates that selected eliminator symbol to determine, as described below, if such a eliminator symbol will eliminate any target symbols.

In certain embodiments, upon a determination to display an eliminator symbol at an eliminator display position, the gaming system displays one or more eliminator symbols and one or more target symbols at that eliminator display position. In certain embodiments, upon a determination to display a target symbol at a target symbol display position, the gaming system displays one or more eliminator symbols and one or more target symbols at that target symbol display position.

In certain embodiments, different wager amounts placed in association with the play of the interacting symbols game (i.e., either on an interacting symbol primary game or on a wagering game associated with an interacting symbol secondary game) are associated with different activated eliminator display positions. In these embodiments, the gaming system randomly generates an eliminator symbol at each activated eliminator display position (and does not generate any eliminator symbol at any inactivated eliminator display position), wherein the wager amount placed determines the quantity of activated eliminator display positions and thus the quantity of eliminator symbols generated. For example, a first wager amount placed activates a first quantity of eliminator display positions and a second, greater wager amount placed activates a second, greater quantity of eliminator display positions. In this example, the first wager amount placed is associated with a first quantity of generated eliminators and the second, greater wager amount placed is associated with a second, greater quantity of generator eliminators.

In an additional or alternative embodiment, different wager amounts placed in association with the play of the interacting symbols game are associated with different available eliminator symbols. In an additional or alternative embodiment, different wager amounts placed in association with the play of the interacting symbols game are associated with different quantities of eliminator symbols available to be generated. In an additional or alternative embodiment, different wager amounts placed in association with the play of the interacting symbols game are associated with different probabilities of generating one or more eliminator symbols at one or more eliminator display positions. For example, the greater the wager amount placed, the greater the probability of each eliminator display position displaying an eliminator symbol having relatively strong associated characteristics, attributes or parameters.

After displaying symbols at the symbol display positions of the matrix, in certain embodiments in which the interacting symbols game is a primary game, the gaming system determines if the displayed symbols form any winning symbol combinations. In these embodiments, if the displayed symbols form at least one winning symbol combination, the gaming system determines and displays the award associated with each displayed winning symbol combination.

Returning to FIG. 1, after populating the symbol display position matrix and the eliminator display positions, the gaming system determines if an eliminator symbol is currently displayed at an eliminator display position associated with any symbol display positions which currently display any target symbols as indicated in diamond 110 of FIG. 1. That is, the gaming system determines if any eliminators currently occupy any eliminator display positions associated with any symbol display positions currently occupied by any target systems such that such eliminators at such eliminator display positions may subsequently engage one or more target symbols as described below.

It should be appreciated that in certain embodiments wherein each eliminator display position is associated with each symbol display position of the symbol display position matrix, this determination includes a determination of if any eliminator symbols are currently displayed at any eliminator display positions and if any target symbols are currently displayed at any symbol display positions. For example, as seen in FIG. 2C, the gaming system determines that since: (i) eliminator display position 204*c* is associated with at least symbol display position 202*a*, (ii) eliminator symbol 210*c* is currently displayed at eliminator display position 204*c*, and (iii) target symbol 208*a* is currently displayed at symbol display position 202*a*, as described below, eliminator symbol 210*c* will engage at least target symbol 208*a*.

If the gaming system determines that no eliminator symbols are currently displayed at any eliminator display positions associated with any symbol display positions which currently display any target symbols, the gaming system returns to block 102 and awaits another occurrence of the interacting symbol game triggering event.

On the other hand, if the gaming system determines that at least one eliminator symbol is currently displayed at at least one eliminator display position associated with at least one symbol display position which currently displays at least one target symbol, as indicated in diamond 112, for the currently displayed eliminator symbol displayed at the eliminator display position associated with a symbol display positions where a target symbol is currently displayed at, the gaming system determines if that eliminator causes an elimination of that target symbol displayed at that associated symbol display position.

As mentioned above, different eliminators have different attributes, characteristics or parameters such that different eliminators have different affects on different target symbols. As such, since different eliminators and different target symbol have different attributes, one eliminator having a first attribute has a different effect on a target symbol than another eliminator having a second attribute. That is, the same target symbol, based at least partially on the attribute of that target symbol and at least partially on the attribute of the eliminator which engages that target symbol, may be eliminated by (or incur a first amount of damage before that target symbol is eliminated) a first eliminator having a first attribute and may not be eliminated by (or may incur a second, different amount of damage before that target symbol is eliminated) a second eliminator having a second, different attribute. For example, as seen in FIG. 2C, eliminator 210*c* has the attribute of a first size which, as described below, can eliminate (or cause an amount of damage to) any target symbol having the attribute of a relatively smaller size, such as target symbols 208*c* and 208*d*. As further seen in this example of FIG. 2C and as described below, eliminator 210*c* having the attribute of the first size cannot eliminate any target symbol having the attribute of an equal size or a relatively larger size, such as target symbols 208*a* and 208*h*.

Figure 2D:
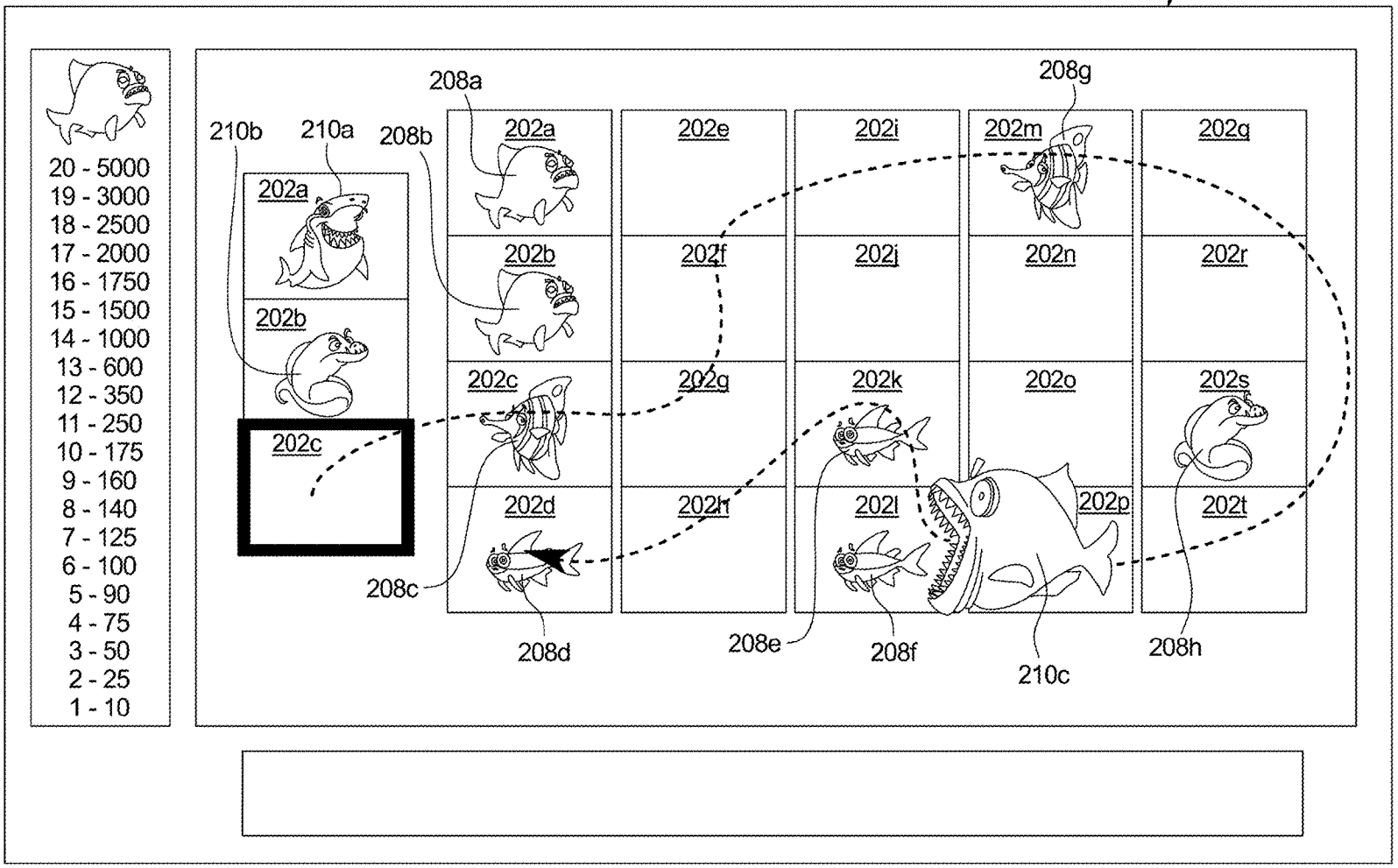

In one embodiment, the gaming system determines which eliminator symbols engage which target symbols based on each eliminator symbols respective eliminator display position. For example, as seen in FIGS. 2C and 2D, the gaming system determines that any eliminator currently displayed at eliminator display position 204*c* engages (and potentially eliminates) target symbols before any eliminator currently displayed at eliminator display position 204*a* or 204*b*.

In another embodiment, the gaming system determines which eliminator symbols engage which target symbols based on each eliminator symbol's respective attributes, characteristics or parameters. For example, as seen in FIGS. 2C and 2D, the gaming system determines that an eliminator with the relative weakest attributes, characteristics or parameters, such as eliminator 210*c* engages (and potentially eliminates) target symbols before any eliminator with any relatively stronger attributes, characteristics or parameters, such as relatively larger eliminators 210*a* and 210*b*.

In different embodiment, different eliminators have different attributes, characteristics or parameters pertaining to how such eliminators engage one or more target symbols. In one example, such an attribute pertains to an amount of damage an eliminator may cause to one or more target symbols. In another example, such an attribute pertains to how frequently an eliminator may damage and/or eliminate a target symbol. In another example, such an attribute pertains to how many target symbols an eliminator may simultaneously damage and/or eliminate.

If the gaming system determines that the eliminator eliminates the target symbol, the gaming system removes the target symbol from the symbol display position matrix as indicated in block 114.

In one embodiment, the gaming system utilizes a point-based system to determine if any engaged target symbols are eliminated. In one such embodiment, the gaming system associates a number of points to each target symbol. In this embodiment, when an eliminator engages a target symbol, the gaming system causes the target symbol to lose or forfeit zero, one or more associated points. If the eliminator causes the total quantity of points remaining for the target symbol to reach a designated threshold quantity, such as zero points remaining, the gaming system marks that target symbol as eliminated. In one such embodiment, the quantity of lost points is based on the attributes of the engaged target symbol and the attributes of the eliminator. It should thus be appreciated that in these embodiments, the number of points of a target symbol define a likelihood or probability of that target symbol surviving an engagement from an eliminator. For example, a first target symbol with a low number of points has a lower relative likelihood of surviving an engagement or attack of an eliminator than a second target symbol with a high number of points.

Following the removal of the target symbol or if the gaming system determines that the eliminator does not eliminate the target symbol, as indicated in block 116, the gaming system determines if the removed target symbol or the non-eliminated target symbol is a last target symbol displayed at a symbol display position associated with the eliminator display position where an eliminator symbol is currently displayed at.

If the removed target symbol or the non-eliminated target symbol is not a last target symbol displayed at a symbol display position associated with the eliminator display position where an eliminator symbol is currently displayed at, the gaming system returns to diamond 112 and determines, for the same currently displayed eliminator symbols displayed at the eliminator display position associated with one of the symbol display positions where another target symbol is currently displayed at, if that same eliminator causes an elimination of the other target symbol displayed at that associated symbol display position.

On the other hand, if the gaming system determines that the removed target symbol or the non-eliminated target symbol is the last target symbol displayed at a symbol display position associated with the eliminator display position where an eliminator symbol is currently displayed at, as indicated in block 118, the gaming system removes the eliminator symbol.

The gaming system then determines and displays any award associated with this removed eliminator symbol as indicated in block 120. In one such embodiment, the award is based on the quantity of eliminated symbols. Such configurations increase the level of excitement and enjoyment for players because as the play of the game progresses, zero, one or more symbols are eliminated, wherein such eliminated symbols affect the amount of the award ultimately provided to the player. Such configurations further provide, for certain players, an increased amount of anticipation associated with not knowing which eliminator symbols and which target symbols will be randomly generated and thus not knowing how such eliminator symbols will interact with such target symbols to determine one or more awards.

In certain embodiments, the gaming system determines an award for each target symbol eliminated. In certain embodiments, the gaming system determines a set or static award for each eliminated target symbol. In certain embodiments, the gaming system determines a variable or dynamic award (e.g., an award selected from a range of awards) for each eliminated target symbol. In certain embodiments, the gaming system determines an exponentially increasing award for each eliminated target symbol. In these embodiments, the greater the quantity of target symbols eliminated by the eliminator, the greater the determined award. In one such embodiment, one or more eliminator symbols are associated with a progressive award wherein if that eliminator symbol engages and eliminates a designated quantity of target symbols, the gaming system provides the player the associated progressive award. In another such embodiment, one or more target symbols are associated with a progressive award wherein if that target symbol is eliminated, the gaming system provides the player the associated progressive award.

Figure 2E:
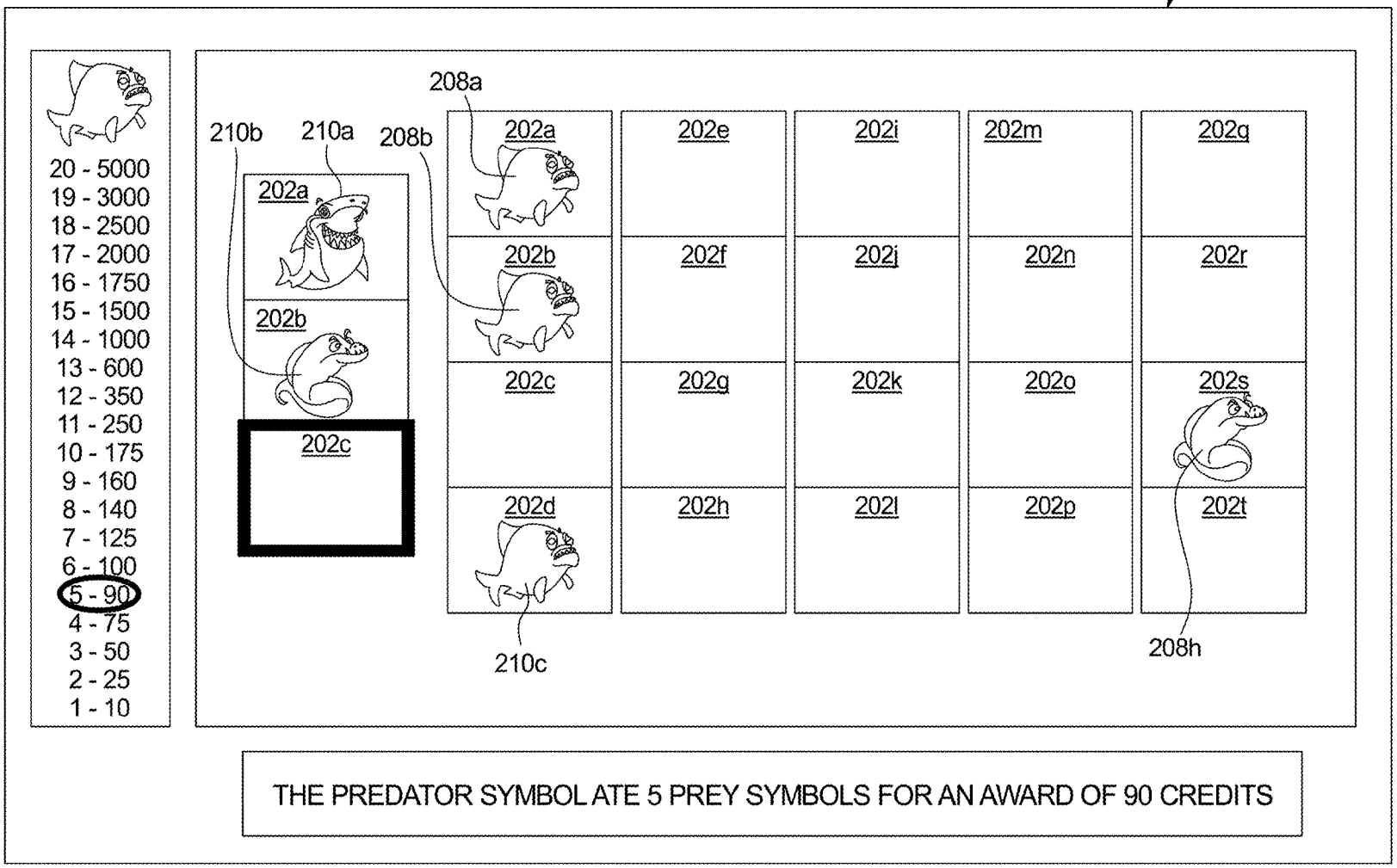

As seen in FIGS. 2D and 2E, following eliminator symbol 210*c* engaging and eliminating, based on the attributes, characteristics or parameters of eliminator symbol 210*c* relative to the attributes, characteristics or parameters of each of target symbols 208*c*, 208*d*, 208*e*, 208*f* and 208*g*, the gaming system utilizes a first paytable to determine an award of ninety credits for eliminating five target symbols. It should be appreciated that in this example, while eliminator symbol 210*c* engaged target symbols 208*a*, 208*b* and 208*h*, based on the attributes, characteristics or parameters of eliminator symbol 210*c* relative to the attributes, characteristics or parameters of each of target symbols 208*a*, 208*b*, and 208*h*, eliminator symbol 210*c* did not eliminate any of target symbols 208*a*, 208*b*, and 208*h*. In this example, the gaming system provides appropriate messages such as "THE PREDATOR SYMBOL ATE 5 PREY SYMBOL FOR AN AWARD OF 90 CREDITS" to the player visually, or through suitable audio or audiovisual displays.

In one embodiment, the gaming system determines an award based on the quantity and types of eliminated target symbols. For example, each eliminated target symbol having the attribute of a first size is associated with an award of fifty credits and each eliminated target symbol having the attribute of a second, different size is associated with an award of one-hundred credits. In another such embodiment, the gaming system determines an award based on a combination of the eliminated target symbols. For example, one eliminated target symbol having the attribute of first size is associated with an award of one-hundred credits, a combination of two eliminated target symbols each having the attribute of the first size is associated with an award of two-hundred-fifty credits and a combination of three eliminated target symbols each having the attribute of the first size is associated with an award of one-thousand credits.

In another embodiment, the gaming system determines an award for the play of the interacting symbol game based on the quantity of non-eliminated target symbols. In this embodiment, the lower the quantity of target symbols eliminated by the eliminators, the greater the determined award. In one such embodiment, the gaming system determines an award based on the quantity and types of non-eliminated target symbols. In another such embodiment, the gaming system determines an award based on a combination of non-eliminated target symbols.

Figure 2F:
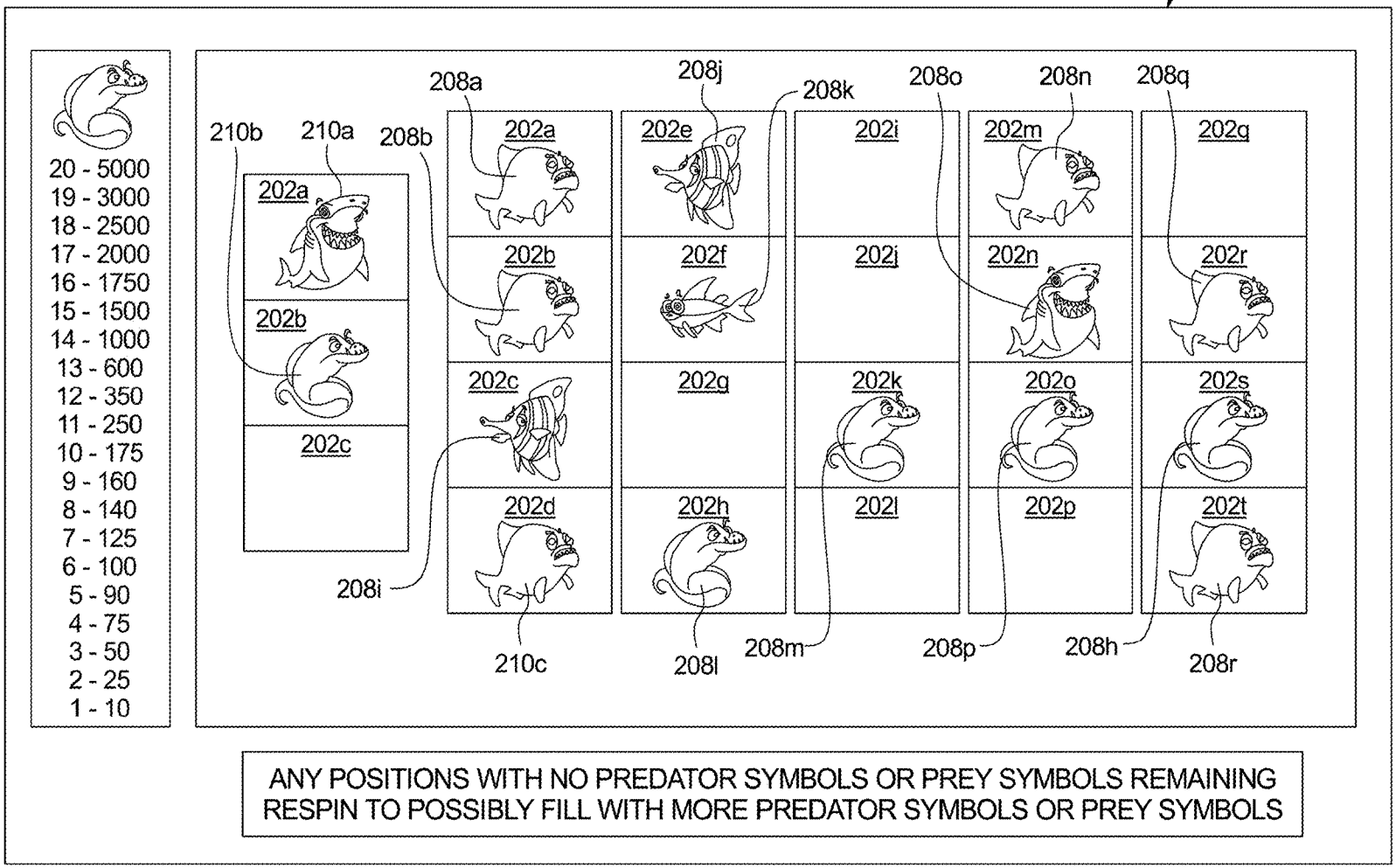

Following the determination and display of any award associated with the target symbols removed from the removed eliminator symbol, the gaming system returns to diamond 110 and determines if an eliminator symbol is currently displayed at an eliminator display position associated with any symbol display positions which currently display any target symbols. That is, the gaming system again determines if any eliminators currently occupy any eliminator display positions associated with any symbol display positions currently occupied by any target systems such that such eliminators at such eliminator display positions may subsequently engage one or more target symbols as described below. For example, as seen in FIG. 2F, the gaming system determines that since: (i) eliminator display position 204*b* is associated with at least symbol display position 202*a*, (ii) eliminator symbol 210*b* is currently displayed at eliminator display position 204*b*, and (iii) target symbol 208*a* is currently displayed at symbol display position 202*a*, eliminator symbol 210*b* will engage at least target symbol 208*a*.

In certain embodiments, following the removal of any target symbols, the gaming system proceeds to determine if any remaining displayed eliminator symbols eliminate any remaining displayed target symbols. In certain embodiments, following the removal of any target symbols, the gaming system repopulates one or more symbol display positions with one or more target symbols. In these embodiments, the gaming system then proceeds to determine if any remaining displayed eliminator symbols eliminate any remaining displayed target symbols (including any newly generated target symbols). For example, as seen in FIG. 2F, following the removal of eliminator symbol 210*c*, the gaming system proceeds to repopulate a plurality of symbol display positions with target symbols. Specifically, the gaming system proceeded with repopulating target symbols 208*i*, 208*j*, 208*k*, 208*l*, 208*m*, 208*n*, 208*o*, 208*p*, 208*q* and 208*r* at symbol display positions 202*c*, 202*e*, 202*f*, 202*h*, 202*k*, 202*m*, 202*n*, 202*o*, 202*r*, and 202*t*, respectively. In this example, the gaming system provides appropriate messages such as "ANY POSITIONS WITH NO PREDATOR SYMBOLS OR PREY SYMBOLS REMAINING RESPIN TO POSSIBLY FILL WITH MORE PREDATOR SYMBOLS OR PREY SYMBOLS" to the player visually, or through suitable audio or audiovisual displays.

In certain embodiments, following the triggering of the interacting symbols secondary game, the gaming system removes any symbols from the symbol display positions which are not either eliminator symbols or target symbols. In another embodiment, following the triggering of the interacting symbols secondary game, the gaming system removes each of the symbols from the symbol display positions. In these embodiments, following this removal, the gaming system repopulates one or more symbol display positions with one or more target symbols. The gaming system then proceeds to determine if any remaining displayed eliminator symbols eliminate any remaining displayed target symbols (including any newly generated target symbols).

Figure 2G:
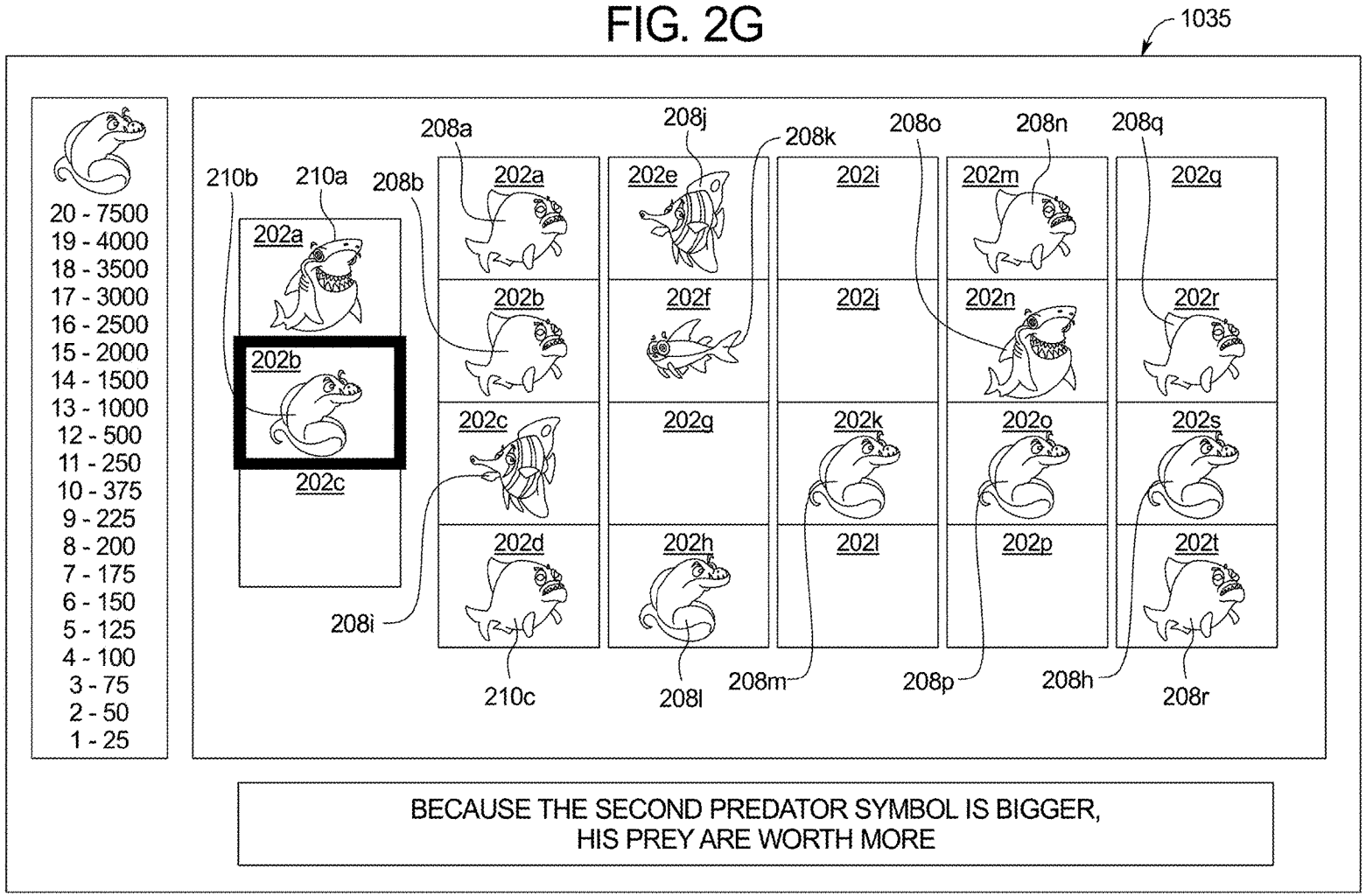
Figure 2H:
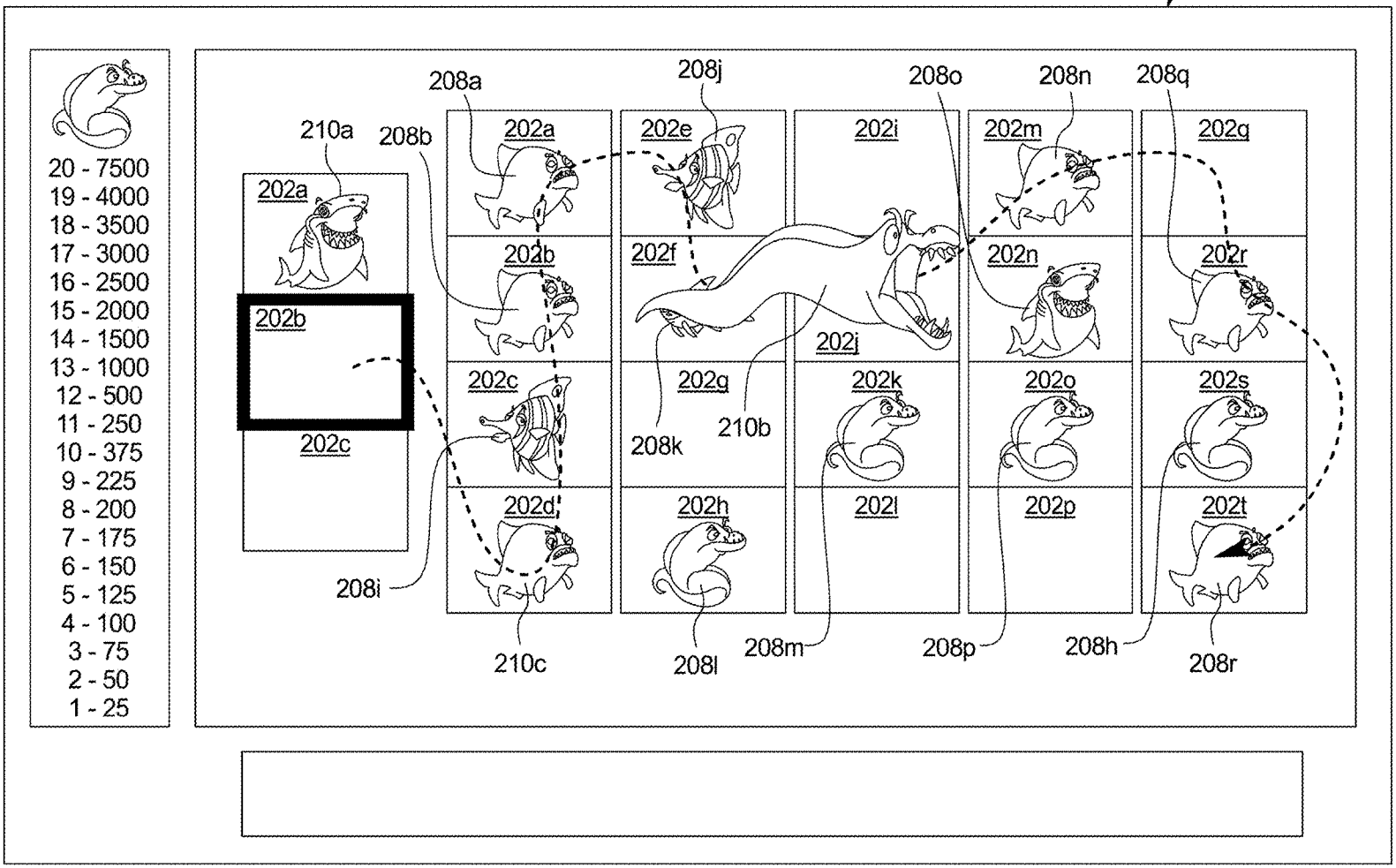
Figure 2I:
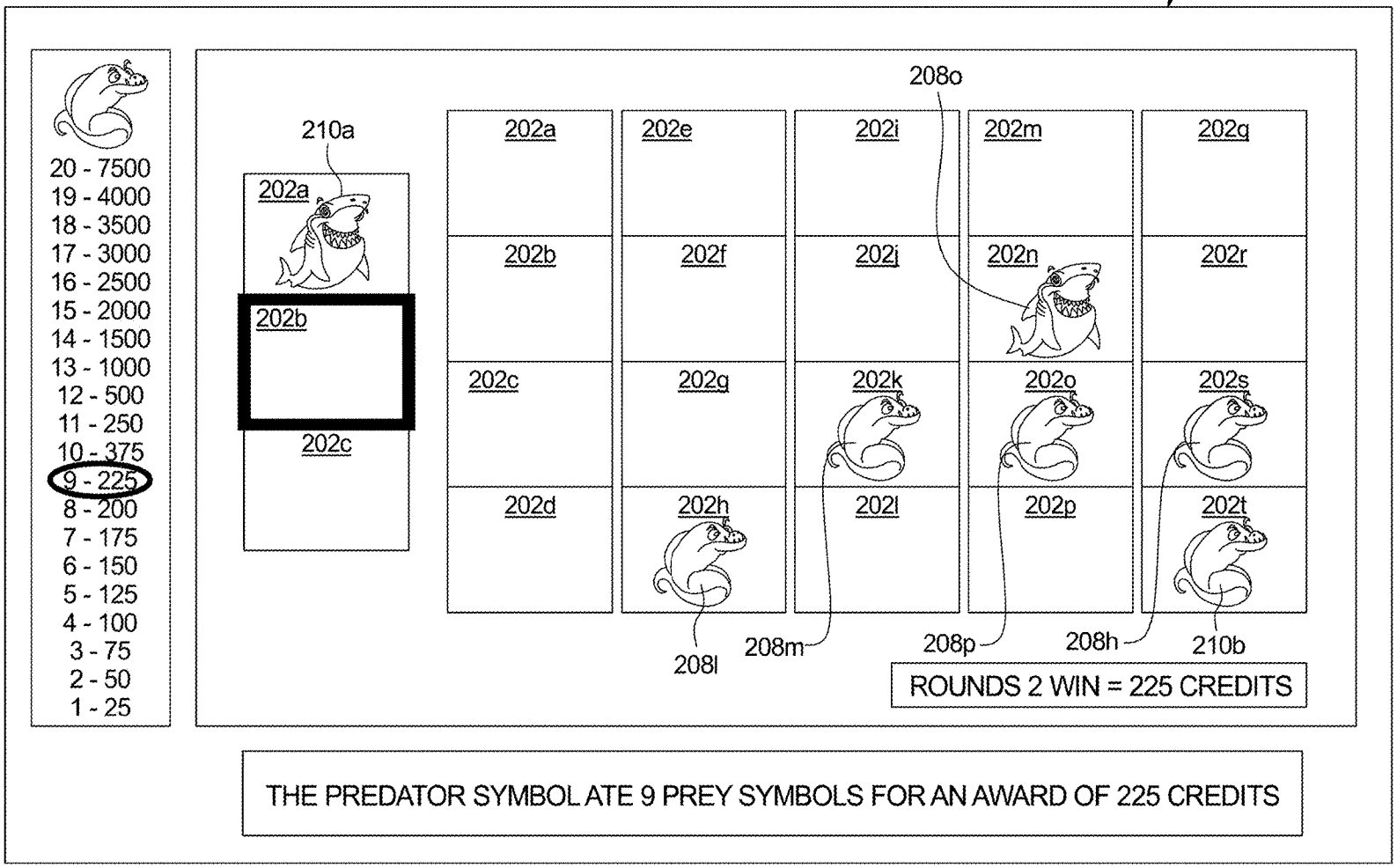
Figure 2J:
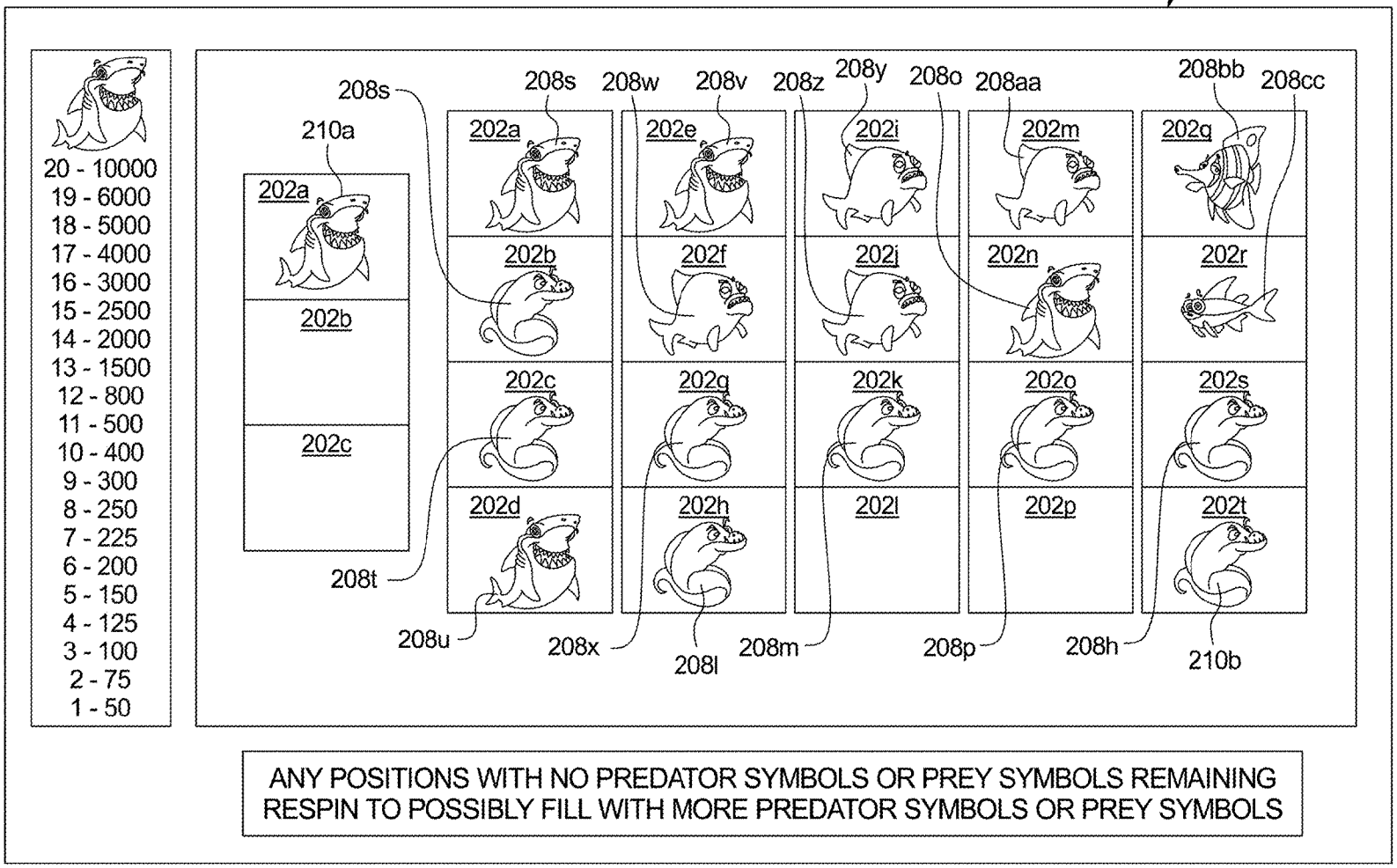
Figure 2K:
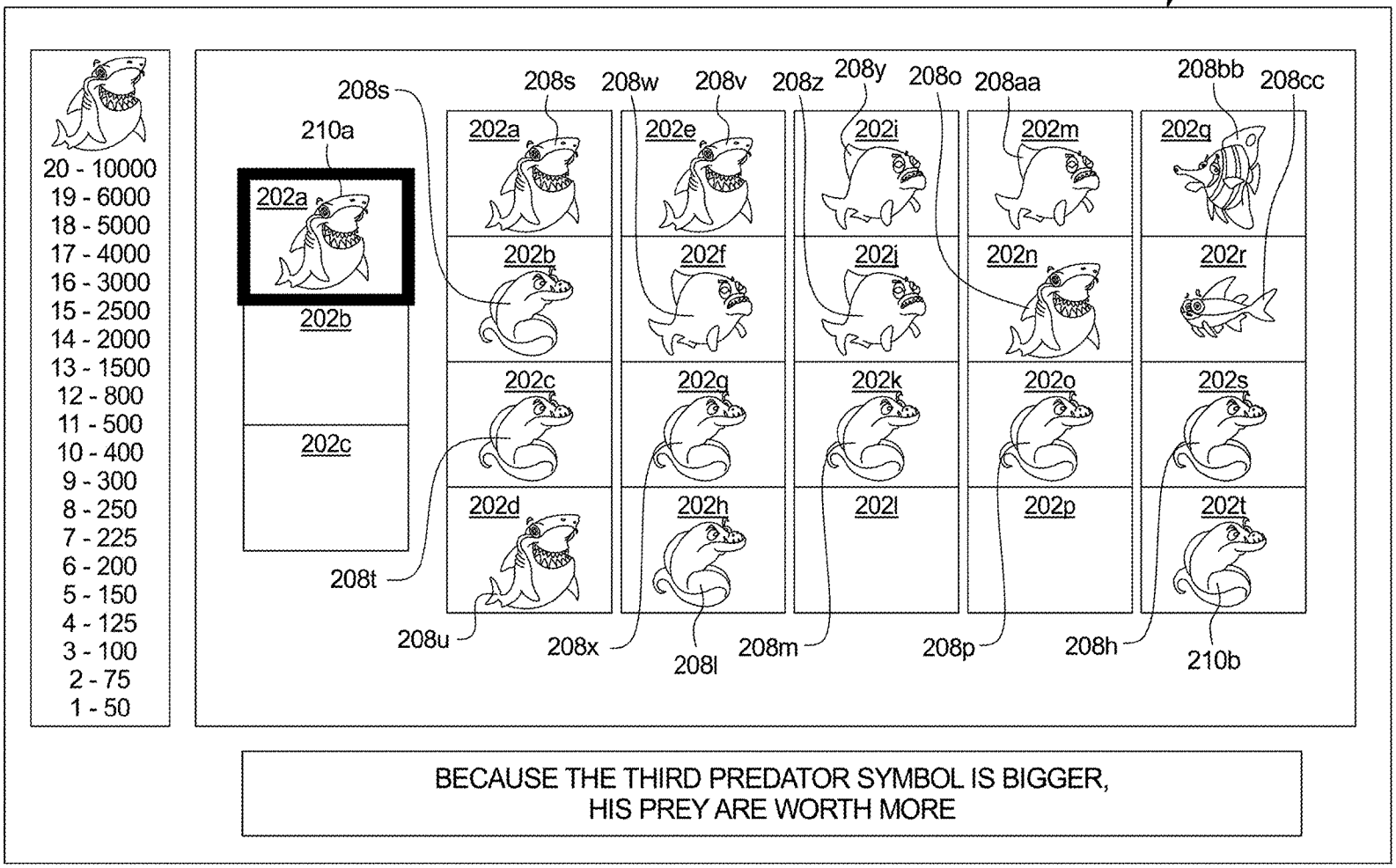
Figure 2L:
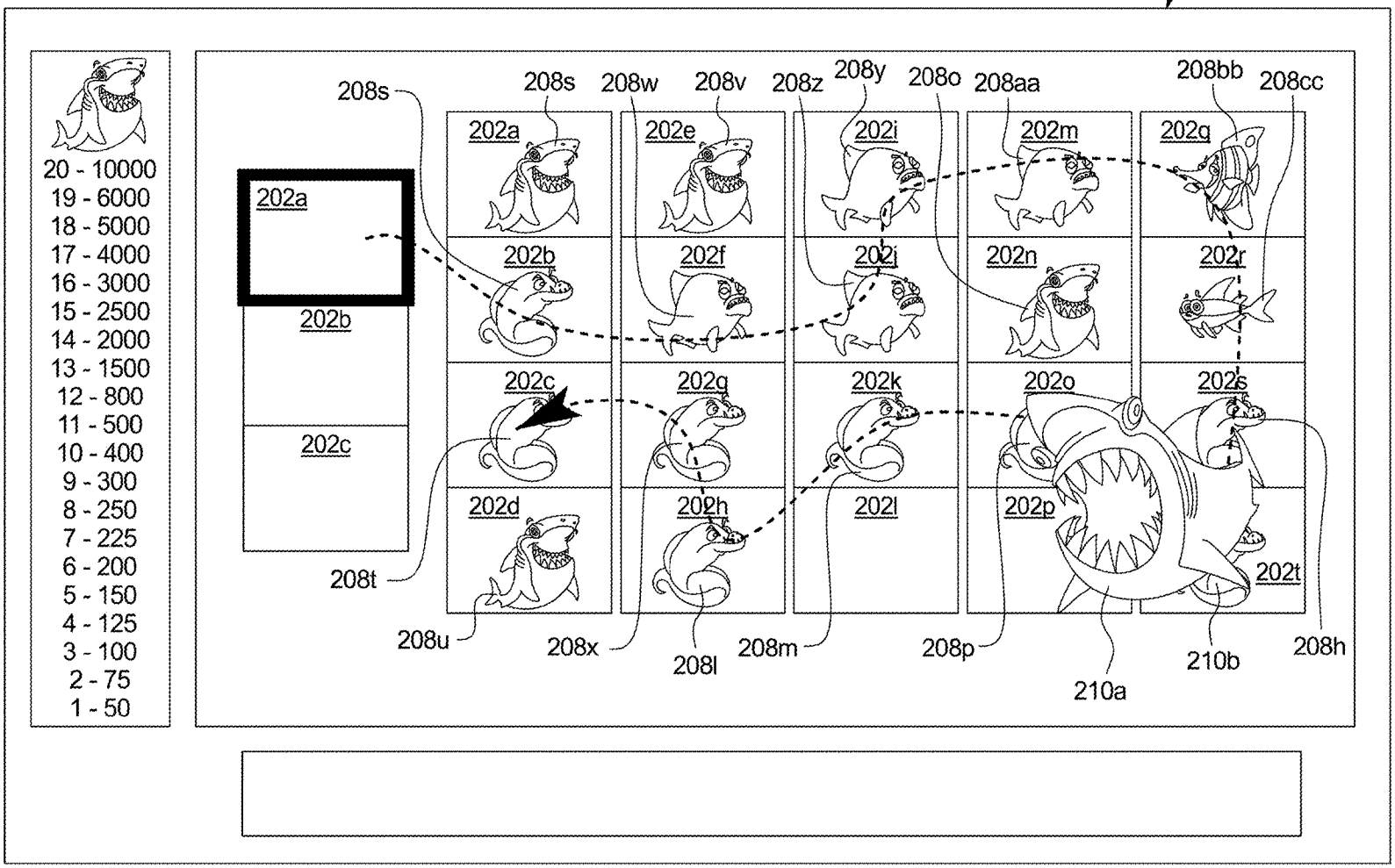
Figure 2M:
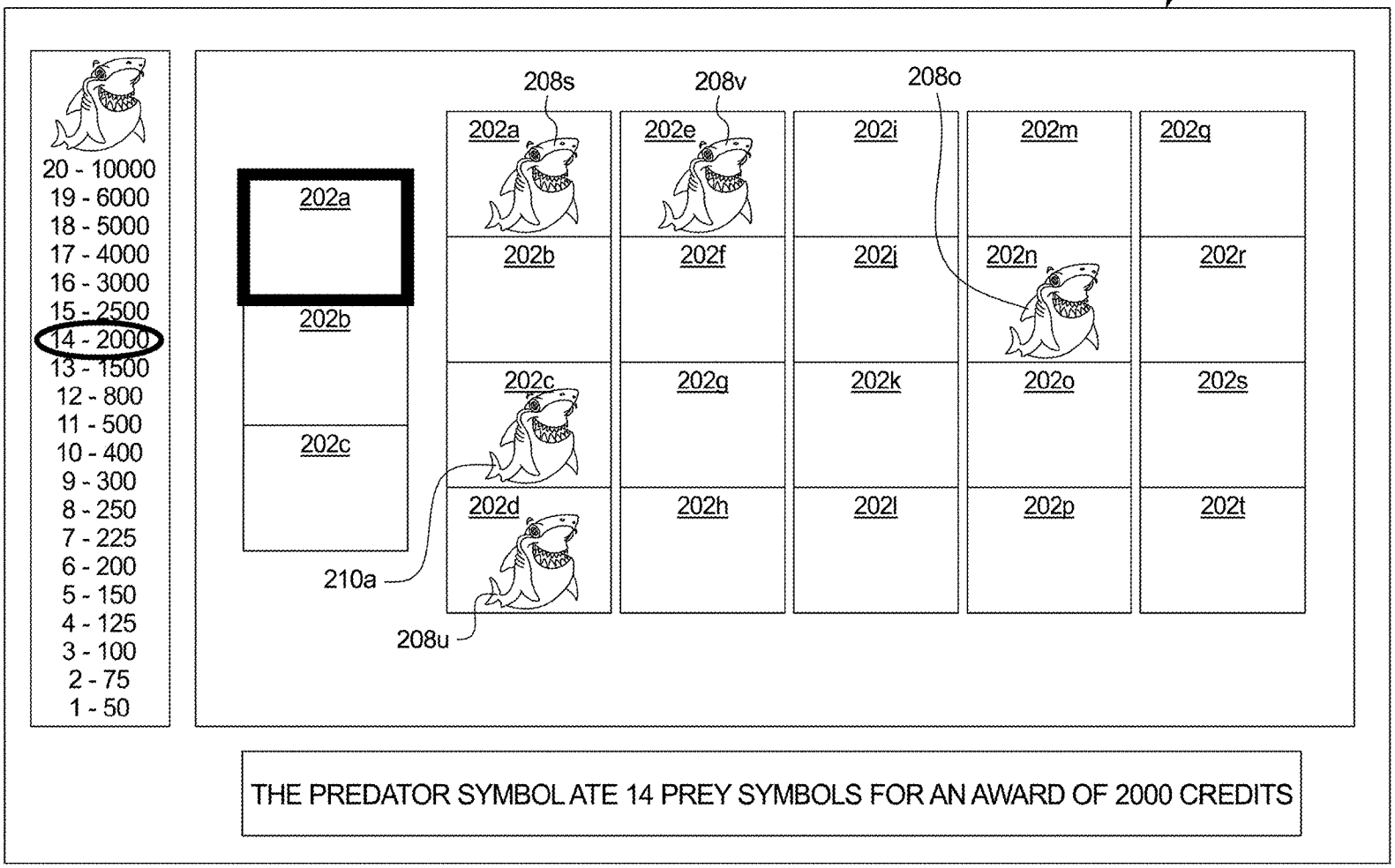
Figure 2N:
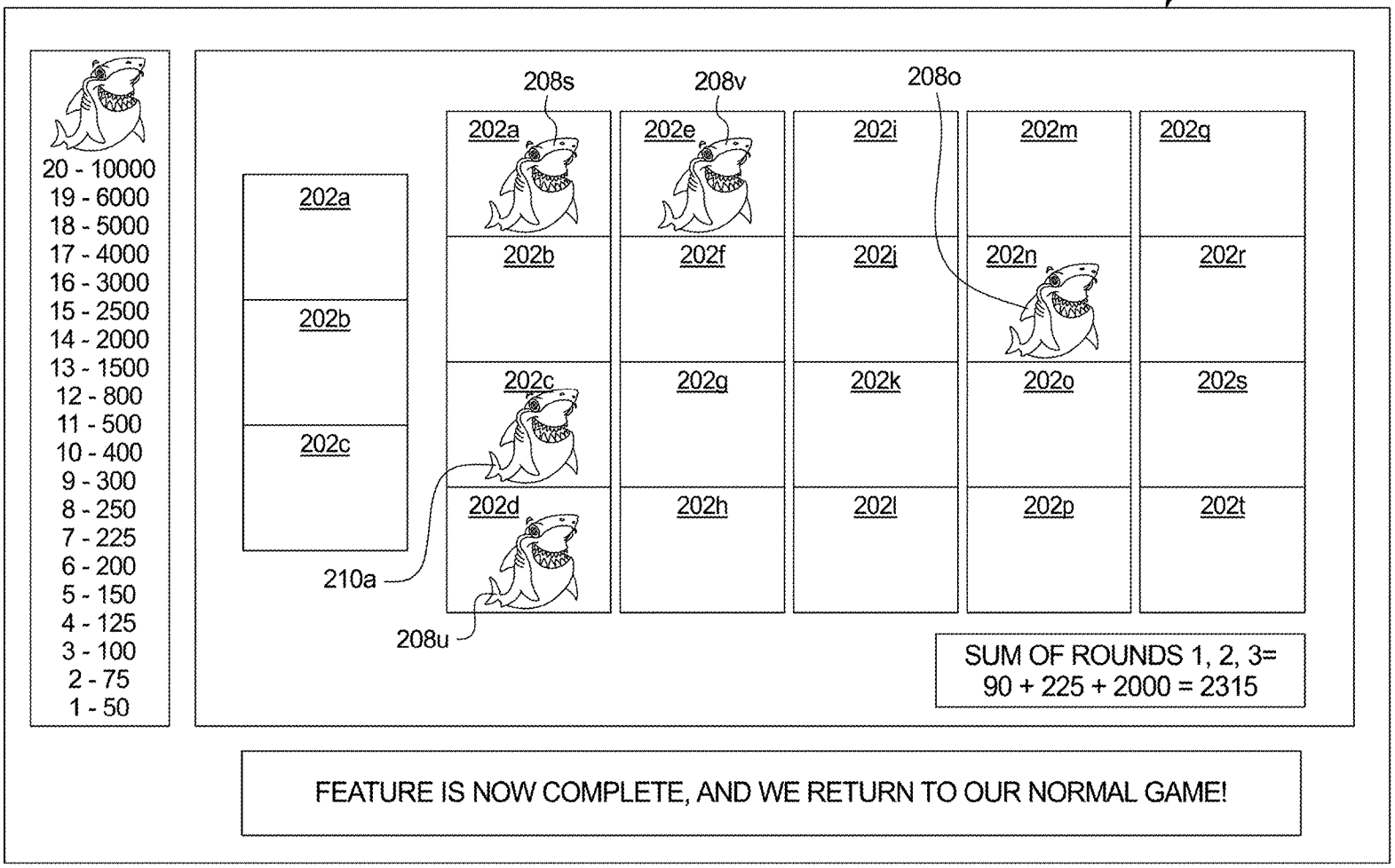

In certain embodiments, the gaming system utilizes the same paytable for each eliminator symbol. In these embodiments, the gaming system provides the same award to a player for the elimination of a same quantity of target symbols, regardless of which eliminator symbol caused the elimination. In certain embodiments, the gaming system utilizes different paytables for different eliminator symbols. In these embodiments, the gaming system provides different awards to a player for the same quantity of eliminated target symbols. For example, as seen in FIG. 2C, the elimination of five target symbols by a first type of eliminator symbol is associated with an award of ninety credits. On the other hand, in this example, as seen in FIG. 2G, the elimination of five target symbols by a second type of eliminator symbol is associated with an award of one-hundred-twenty-five credits. In this example, as seen in FIG. 2G, the gaming system provides appropriate messages such as "BECAUSE THE SECOND PREDATOR SYMBOL IS BIGGER, HIS PREY ARE WORTH MORE" to the player visually, or through suitable audio or audiovisual displays.

In one embodiment, the interacting symbol game disclosed herein is played as a primary game wherein zero, one or more eliminators eliminate zero, one or more target symbols displayed in the symbol display position matrix. In one such embodiment, following the elimination of any target symbols (and the subsequent determination of any award associated with the eliminated target symbols), the gaming system proceeds to repopulate the created empty symbol display position with additional symbols, such as additional target symbols or additional non-target symbols.

In another embodiment, the interacting symbol game disclosed herein is played as both a primary wagering game and a secondary game. In this embodiment, upon the triggering of the secondary game, the gaming system modifies one or more aspects of the interacting symbol primary game for the interacting symbol secondary game. In different examples, for the play of the secondary game, the gaming system utilizes one or more of: an increased quantity of eliminator symbols, an increased quantity of target symbols, more lucrative eliminator symbols, more lucrative target symbols, an increased quantity of eliminator symbols with relatively stronger characteristics, attributes or parameters, an increased quantity of target symbols with relatively weaker characteristics, attributes or parameters, modifiers, such as multipliers, displayable in the symbol display position matrix, modifiers, such as multipliers, displayable at the eliminator display positions, additional eliminator display positions, utilizing eliminator display positions at different locations relative to the symbol display position matrix (e.g., the eliminator reel is positioned at a different location relative to the symbol display position matrix).

In one embodiment, the gaming system enables one or more players to select one or more eliminator display positions. In one such embodiment, enabling players to place eliminators at different eliminator display positions introduces an element of strategy or skill. In one such embodiment, after a player places one or more eliminators at one or more eliminator display positions, the gaming system determines whether such placed eliminator symbols eliminate any target symbols as described herein. In another embodiment, the gaming system enables a player to modify one or more attributes of one or more target symbols and/or one or more eliminators. In another embodiment, the gaming system causes one or more eliminators to move or switch locations (relative to the symbol display positions) as the interacting symbol game is played.

In one embodiment, one or more (or each) eliminator is configured to engage one target symbol at a time. In another embodiment, one or more (or each) eliminator is configured to engage a plurality of target symbols at a time. For example, one or more (or each) eliminator includes a mega-eliminator which is configured to engage (and eliminate) each of the target symbols currently displayed at each of the symbol display positions. In another embodiment, the gaming system causes one eliminator to engage zero, one or more target symbols at a time. In another embodiment, the gaming system causes a plurality of eliminators to each engage zero, one or more target symbols at a time.

In one embodiment, as described above, the gaming system removes each eliminated target symbol. In one such embodiment, zero, one or more of the remaining, non-eliminated target symbols move to occupy the empty symbol display position caused by the removal of the eliminated target symbol. In this embodiment, such movement may affect whether or not such moved target symbols are eliminated. In another embodiment, the gaming system removes each eliminated target symbol and otherwise maintains the relationship of the remaining target symbols. In another embodiment, after engaging one or more target symbols, one or more eliminators remain at one or more symbol display positions. In this embodiment, the eliminator for one phase of the interacting symbol game functions as a target symbol for another phase of the interacting symbol game.

In one embodiment, as described above, any award provided to the player is based on the quantity of target symbols that are eliminated. In another embodiment, as further described above, any award provided to the player is based on the quantity of target symbols that survive (i.e., the quantity of target symbols not eliminated). In another embodiment, any award provided to the player is based on both the quantity of certain target symbols that are eliminated and the quantity of certain target symbols that are not eliminated.

In one embodiment, as described above, the gaming system includes one or more eliminators displayed at one or more eliminator display positions wherein such eliminators destroy or eliminate zero, one or more of the target symbols. In another embodiment, if an eliminator engages a target symbol displayed at a symbol display position associated with that eliminator's eliminator display position, the gaming system causes the eliminator to decrease any award value associated with that target symbol.

In one embodiment, the gaming system provides a group gaming aspect to the interacting symbol game disclosed herein. In one such embodiment, the interacting symbol game is a cooperative community game wherein a plurality of players cooperate or play together to win one or more awards. In another such embodiment, the interacting symbol game is a competition community game wherein a plurality of players compete or player against each other to win one or more awards.

In one embodiment wherein the interacting symbol game is a cooperative community game, the gaming system provides, to each of the players (or to a plurality of the players) of the community game, the award associated with the quantity of target symbols that are eliminated. In one embodiment wherein the interacting symbol game is a competitive community game, the gaming system associated each of the players with one or more eliminator symbols. In this embodiment, the gaming system determines an award for each player based on the target symbols eliminated by that player's associated eliminator symbol. Such a configuration provides an element of competition as each eliminator symbols (and thus each player) races to eliminate a respective target symbol first.

In different embodiments, one or more awards provided in association with the interacting symbol game include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In one embodiment, the gaming system causes at least one display device of an electronic gaming machine ("EGM") to display the interacting symbol game. In another embodiment, in addition or in alternative to each EGM displaying the interacting symbol game, the gaming system causes one or more community or overhead display devices to display part or all of the interacting symbol game to one or more other players or bystanders either at a gaming establishment or viewing over a network, such as the internet. In another embodiment, in addition or in alternative to each EGM displaying the interacting symbol game, the gaming system causes one or more internet sites to each display the interacting symbol game such that a player is enabled to log on from a personal web browser. In another such embodiment, the gaming system enables the player to play one or more primary games on one device while viewing the interacting symbol game from another device. For example, the gaming system enables the player to play one or more primary games on a mobile phone while viewing the status of the interacting symbol game on a desktop or laptop computer.

In different embodiments, an interacting symbol game triggering event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, the gaming system does not provide any apparent reasons to the players for an occurrence of an interacting symbol game triggering event. In these embodiments, such determinations are not triggered by an event in a primary game or based specifically on any of the plays of any primary games. That is, these events occur without any explanation or alternatively with simple explanations.

In one such embodiment, an interacting symbol game triggering event occurs based on an amount of coin-in. In this embodiment, the gaming system determines if an amount of coin-in reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, an interacting symbol game triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, an interacting symbol game triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, an interacting symbol game triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, an interacting symbol game triggering event occurs based on a predefined variable reaching a defined parameter threshold. For example, when the 500,000$^{th}$ player has played an EGM (ascertained from a player tracking system), one or more of such events or conditions occur. In different embodiments, the predefined parameter thresholds include a length of time, a length of time after a certain dollar amount is hit, a wager level threshold for a specific device (which EGM is the first to contribute $250,000), a number of EGMs active, or any other parameter that defines a suitable threshold.

In different embodiments, an interacting symbol game triggering event occurs based on a quantity of games played. In this embodiment, a quantity of games played is set for when one or more of such events or conditions will occur. In one embodiment, such a set quantity of games played is based on historic data.

In different embodiments, an interacting symbol game triggering event occurs based on time. In this embodiment, a time is set for when one or more of such events or conditions will occur. In one embodiment, such a set time is based on historic data.

In different embodiments, an interacting symbol game triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the EGM. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, an interacting symbol game triggering event occurs based on a system determination, including one or more random selections by the central controller. In one embodiment, as described above, the gaming system tracks all active EGMs and the wagers they placed. In one such embodiment, based on the EGM's state as well as one or more wager pools associated with the EGM, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, an interacting symbol game triggering event occurs based on a determination of if any numbers allotted to an EGM match a randomly selected number. In this embodiment, upon or prior to each play of each EGM, an EGM selects a random number from a range of numbers and during each primary game, the EGM allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing an interacting symbol game triggering event to occur may be implemented in accordance with the gaming system and method disclosed herein.

It should be appreciated that one or more of the above-described triggers pertaining to an interacting symbol game triggering event occurring may be combined in one or more different embodiments.

Alternative Embodiments

It should be appreciated that in different embodiments, one or more of:

i. a quantity of symbol display positions to potentially generate one or more target symbols at;
ii. a quantity of eliminator display positions to potentially generate one or more eliminator symbols at
iii. a quantity of symbols simultaneously or overlappingly displayed by one or more of the symbol display positions;
iv. a quantity of eliminator display positions associated with the symbol display positions;
v. a location of one or more eliminator display positions;
vi. which symbol display positions are associated with which eliminator display positions;
vii. which eliminators have which attributes;
viii. a quantity of attributes one or more eliminators have;
ix. a quantity of target symbols generated;
x. which target symbols have which attributes;
xi. a quantity of attributes one or more target symbols have;
xii. an order which eliminators engage target symbols;
xiii. whether an eliminator engages a target symbol;
xiv. a quantity of target symbols an eliminator engages at once;
xv. a quantity of target symbols that an eliminator engages over a designated period of time;
xvi. a frequency which an eliminator engages one or more target symbols;
xvii. a range of symbol display positions an eliminator at an eliminator display position engages a target symbol at;
xviii. whether an eliminator eliminates a target symbol;
xix. a quantity of target symbols an eliminator eliminates at once;
xx. a quantity of target symbols an eliminator eliminates over a designated period of time;
xxi. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 3:
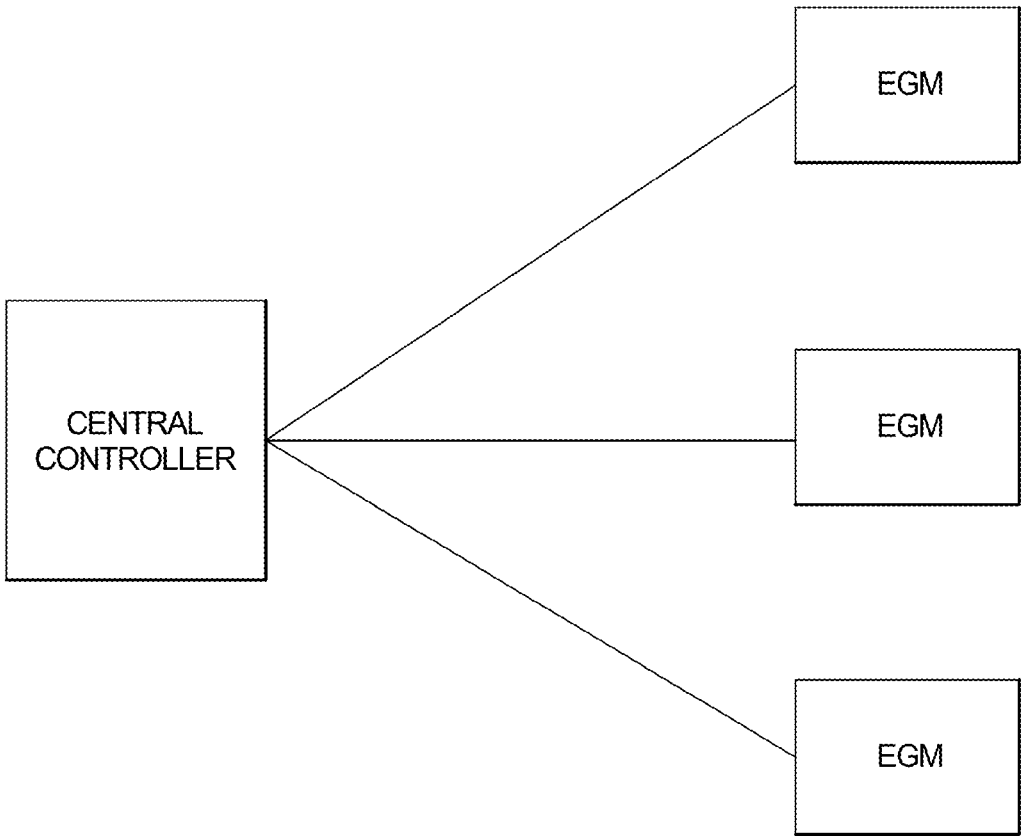
FIG. 3 is a schematic block diagram of one embodiment of a network configuration of the gaming system disclosed herein.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 3 includes a plurality of EGMs that are each configured to communicate with a central server, central controller, or remote host through a data network.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4:
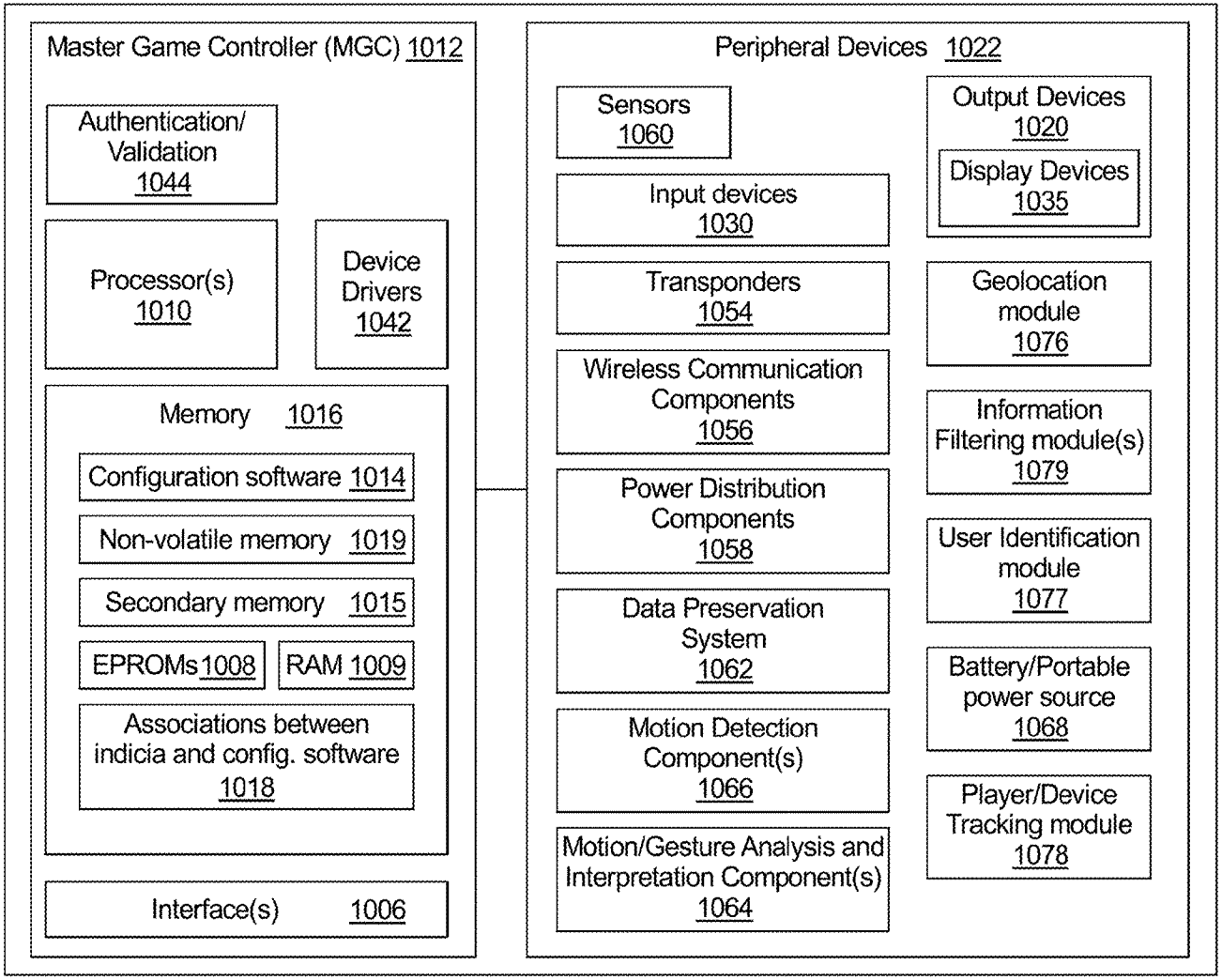
FIG. 4 is a schematic block diagram of one embodiment of an electronic configuration of an example gaming system disclosed herein.
Figure 5A:
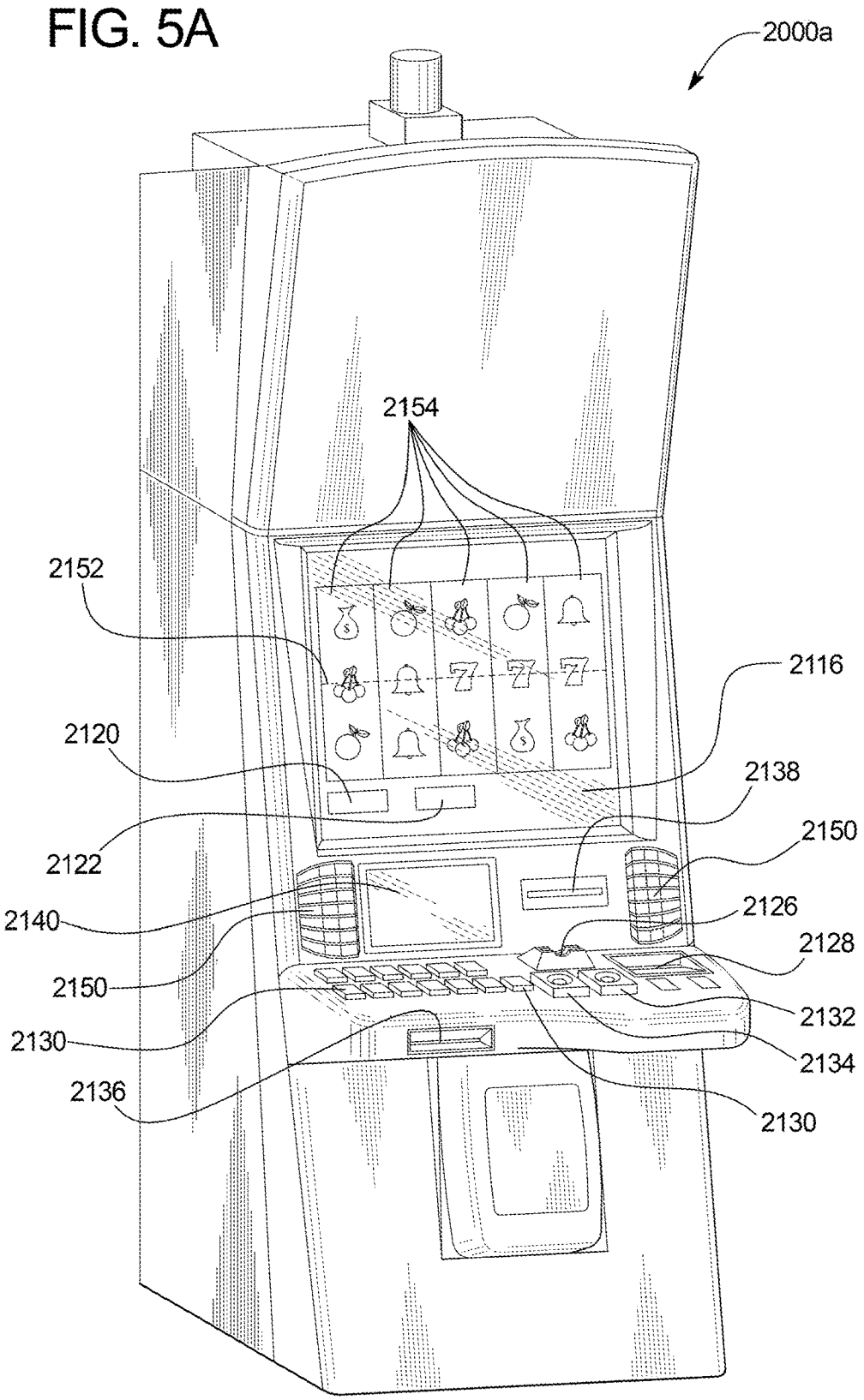
FIGS. 5A and 5B are perspective views of example alternative embodiments of the gaming system disclosed herein.
Figure 5B:
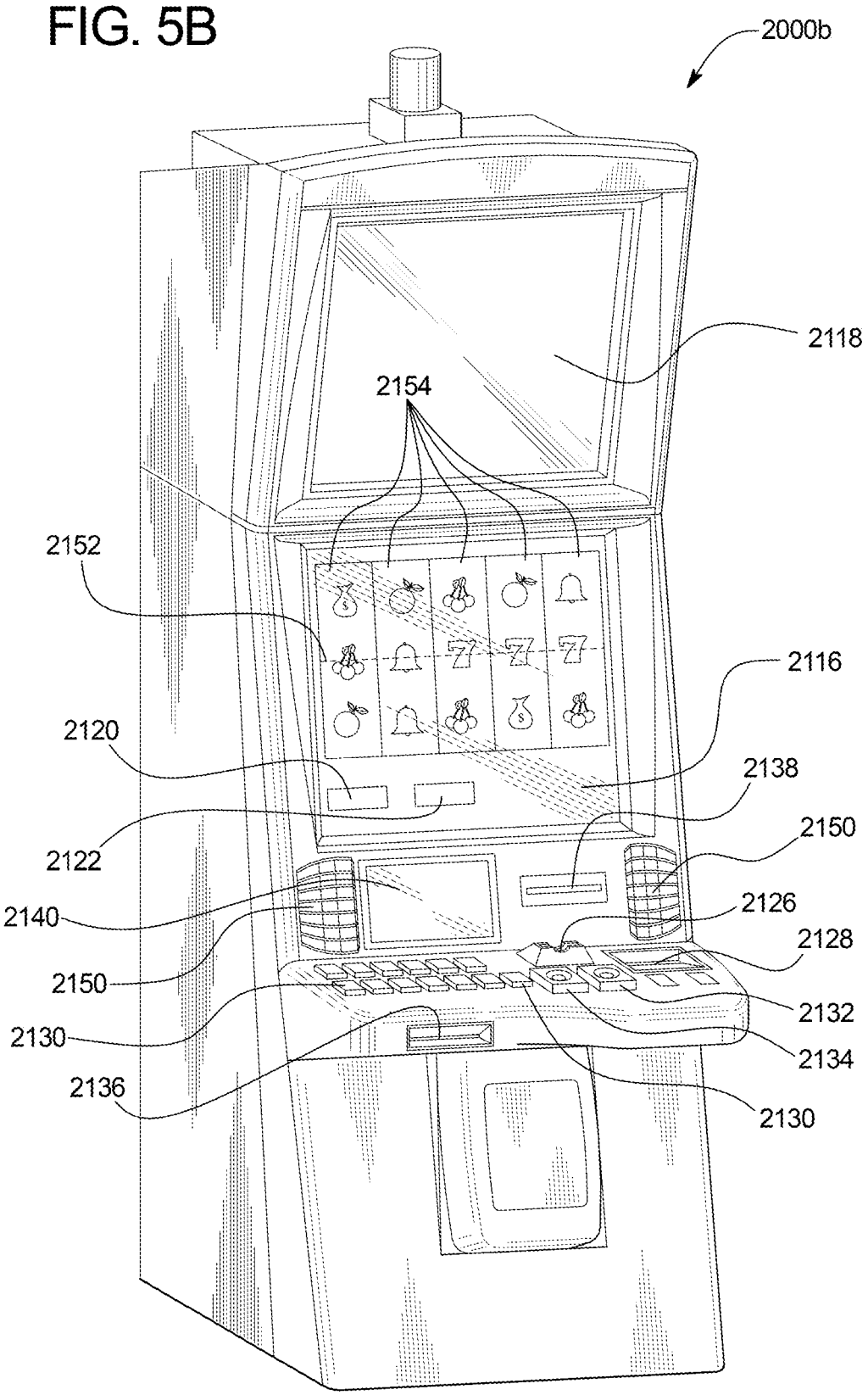

FIG. 4 is a block diagram of an example EGM 1000 and FIGS. 5A and 5B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 5A includes a central display device 2116, a player tracking display 2140, a credit display 2120, and a bet display 2122. The example EGM 2000*b* illustrated in FIG. 5B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 5A and 5B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 5A and 5B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrates in FIGS. 5A and 5B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 5A and 5B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 5A and 5B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 5A and 5B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 5A and 5B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA, Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 5A and 5B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 5A and 5B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM 2000*b* shown in FIG. 5B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one display device;

at least one processor; and at least one memory device which stores a plurality of instructions, which when executed by the at least one processor upon an occurrence of a triggering event, cause the at least one processor to:

(a) at each of a plurality of symbol display positions, cause the at least one display device to display a target symbol randomly determined from a plurality of target symbols, wherein at least two of said target symbols each have a different target symbol attribute and each of the target symbols are concurrently displayed, (b) at a predetermined eliminator display position, cause the at least one display device to display an eliminator randomly determined from a plurality of different eliminators, wherein said predetermined eliminator display position is associated with at least one of the symbol display positions and at least two of said eliminators each have a different eliminator attribute, (c) thereafter, for the eliminator displayed at the predetermined eliminator display position, responsive to any of the target symbols being displayed at any of the symbol display positions associated with said predetermined eliminator display position, determine if the eliminator displayed at the predetermined eliminator display position eliminates the target symbol displayed at the associated symbol display position, said determination being based on the target symbol attribute of the target symbol and the eliminator attribute of the eliminator, (d) separate from a quantity of the eliminators which are displayed, determine an award associated with a quantity of eliminated target symbols, and (e) cause the at least one display device to display the determined award.

2. The gaming system of claim 1, wherein a first one of the target symbols having a first target symbol attribute is eliminated by a first one of the eliminators having a first eliminator attribute and not eliminated by a second one of the eliminators having a second, different eliminator attribute.

3. The gaming system of claim 1, wherein when executed by the at least one processor, the plurality of instructions cause the at least one processor to repeat (c) to (e) for another predetermined eliminator displayed at another eliminator display position.

4. The gaming system of claim 3, wherein when executed by the at least one processor, the plurality of instructions cause the at least one processor to cause the at least one display device to display, at each of the plurality of symbol display positions, a target symbol randomly determined from the plurality of target symbols, prior to repeating (c) to (e) at least once.

5. The gaming system of claim 3, wherein a first of the plurality of eliminators is associated with a first paytable utilized to determine any award and a second of the plurality of eliminators is associated with a second, different paytable utilized to determine any award.

6. The gaming system of claim 1, wherein a first wager amount placed in association with the occurrence of the triggering event is associated with a first quantity of predetermined eliminator display positions at which one of the eliminators is displayed at and a second, greater wager amount placed in association with the occurrence of the triggering event is associated with a second, greater quantity of predetermined eliminator display positions at which one of the eliminators is displayed at.

7. The gaming system of claim 1, further comprising an acceptor, wherein when executed by the at least one processor, the plurality of instructions cause the at least one processor to: responsive to a physical item being received via the acceptor, establish a credit balance based, at least in part, on a monetary value associated with the received physical item, and responsive to a cashout input being received, cause an initiation of any payout associated with the credit balance.

8. A gaming system server comprising:

at least one processor; and at least one memory device which stores a plurality of instructions, which when executed by the at least one processor upon an occurrence of a triggering event, cause the at least one processor to:

(a) at each of a plurality of symbol display positions, cause at least one display device to display a target symbol randomly determined from a plurality of target symbols, wherein at least two of said target symbols each have a different target symbol attribute and each of the target symbols are concurrently displayed, (b) at a predetermined eliminator display position, cause the at least one display device to display an eliminator randomly determined from a plurality of different eliminators, wherein said predetermined eliminator display position is associated with at least one of the symbol display positions and at least two of said eliminators each have a different eliminator attribute, (c) thereafter, for the eliminator displayed at the predetermined eliminator display position, responsive to any of the target symbols being displayed at any of the symbol display positions associated with said predetermined eliminator display position, determine if the eliminator displayed at the predetermined eliminator display position eliminates the target symbol displayed at the associated symbol display position, said determination being based on the target symbol attribute of the target symbol and the eliminator attribute of the eliminator, (d) separate from a quantity of the eliminators which are displayed, determine an award associated with a quantity of eliminated target symbols, and (e) cause the at least one display device to display the determined award.

9. The gaming system server of claim 8, wherein a first one of the target symbols having a first target symbol attribute is eliminated by a first one of the eliminators having a first eliminator attribute and not eliminated by a second one of the eliminators having a second, different eliminator attribute.

10. The gaming system server of claim 8, wherein when executed by the at least one processor, the plurality of instructions cause the at least one processor to repeat (c) to (e) for another predetermined eliminator displayed at another eliminator display position.

11. The gaming system server of claim 10, wherein when executed by the at least one processor, the plurality of instructions cause the at least one processor to cause the at least one display device to display, at each of the plurality of symbol display positions, a target symbol randomly determined from the plurality of target symbols, prior to repeating (c) to (e) at least once.

12. The gaming system server of claim 10, wherein a first of the plurality of eliminators is associated with a first paytable utilized to determine any award and a second of the plurality of eliminators is associated with a second, different paytable utilized to determine any award.

13. The gaming system server of claim 8, wherein a first wager amount placed in association with the occurrence of the triggering event is associated with a first quantity of predetermined eliminator display positions at which one of the eliminators is displayed at and a second, greater wager amount placed in association with the occurrence of the triggering event is associated with a second, greater quantity of predetermined eliminator display positions at which one of the eliminators is displayed at.

14. The gaming system server of claim 8, wherein a credit balance is increasable based on the determined award, said credit balance being increasable via an acceptor of a physical item associated with a monetary value, and said credit balance being decreasable via a cashout device.

15. A method of operating a gaming system upon an occurrence of a triggering event, said method comprising:

(a) at each of a plurality of symbol display positions, displaying, by at least one display device, a target symbol randomly determined from a plurality of target symbols, wherein at least two of said target symbols each have a different target symbol attribute and each of the target symbols are concurrently displayed, (b) at a predetermined eliminator display position, displaying, by the at least one display device, an eliminator randomly determined from a plurality of different eliminators, wherein said predetermined eliminator display position is associated with at least one of the symbol display positions and at least two of said eliminators each have a different eliminator attribute, (c) thereafter, for the eliminator displayed at the predetermined eliminator display position, responsive to any of the target symbols being displayed at any of the symbol display positions associated with said predetermined eliminator display position, determining, by at least one processor, if the predetermined eliminator displayed at the eliminator display position eliminates the target symbol displayed at the associated symbol display position, said determination being based on the target symbol attribute of the target symbol and the eliminator attribute of the eliminator, (d) separate from a quantity of eliminators which are displayed, determining, by the at least one processor, an award associated with a quantity of eliminated target symbols, and (e) displaying, by the at least one display device, the determined award.

16. The method of claim 15, wherein a first one of the target symbols having a first target symbol attribute is eliminated by a first one of the eliminators having a first eliminator attribute and not eliminated by a second one of the eliminators having a second, different eliminator attribute.

17. The method of claim 15, further comprising repeating (c) to (e) for another predetermined eliminator displayed at another eliminator display position.

18. The method of claim 17, further comprising displaying, by the at least one display device and at each of the plurality of symbol display positions, a target symbol randomly determined from the plurality of target symbols, prior to repeating (c) to (e) at least once.

19. The method of claim 17, wherein a first of the plurality of eliminators is associated with a first paytable utilized to determine any award and a second of the plurality of eliminators is associated with a second, different paytable utilized to determine any award.

20. The method of claim 15, wherein a first wager amount placed in association with the occurrence of the triggering event is associated with a first quantity of predetermined eliminator display positions at which one of the eliminators is displayed at and a second, greater wager amount placed in association with the occurrence of the triggering event is associated with a second, greater quantity of predetermined eliminator display positions at which one of the eliminators is displayed at.

21. The method of claim 15, wherein a credit balance is increasable based on the determined award, said credit balance being increasable via an acceptor of a physical item associated with a monetary value, and said credit balance being decreasable via a cashout device.

* * * * *